US012752331B2

(12) United States Patent
Wada et al.

(10) Patent No.: US 12,752,331 B2
(45) Date of Patent: Oct. 6, 2026

(54) WORKPIECE TRANSFER METHOD, WORKPIECE TRANSFER DEVICE, AND WORKPIECE TRANSFER PROGRAM

(71) Applicant: KAWASAKI JUKOGYO KABUSHIKI KAISHA, Kobe (JP)

(72) Inventors: Takumi Wada, Kobe (JP); Hiroki Oribe, Kobe (JP); Takashi Kitahata, Kobe (JP); Shunya Azami, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 371 days.

(21) Appl. No.: 18/372,191

(22) Filed: Sep. 25, 2023

(65) Prior Publication Data

US 2024/0024943 A1 Jan. 25, 2024

Related U.S. Application Data

(63) Continuation of application No. PCT/JP2022/014741, filed on Mar. 25, 2022.
(Continued)

(51) Int. Cl.
*B21D 43/09* (2006.01)
*B21D 5/02* (2006.01)
*B21D 43/18* (2006.01)

(52) U.S. Cl.
CPC ..... *B21D 43/09* (2013.01); *B21D 5/0281* (2013.01); *B21D 43/18* (2013.01)

(58) Field of Classification Search
CPC ..... B21D 5/002; B21D 5/0281; B21D 43/09; B21D 43/18; B21D 43/08
See application file for complete search history.

(56) References Cited

U.S. PATENT DOCUMENTS 9,682,414 B2 * 6/2017 Ichioka ..... B21D 43/003
10,207,308 B2 * 2/2019 Kowal ..... B21D 28/04
(Continued)

FOREIGN PATENT DOCUMENTS

CH 500023 A 12/1970
DE 1056084 B 4/1959
(Continued)

OTHER PUBLICATIONS

DE 4235192A1, Karls Apr. 1994.*
(Continued)

*Primary Examiner* — Edward T Tolan
(74) *Attorney, Agent, or Firm* — XSENSUS LLP

(57) ABSTRACT

A workpiece transfer method is for transferring a workpiece when bending of the workpiece is performed by a press brake including a die and a punch, the workpiece transfer method including, before or after the bending: moving an upstream transferer in a transfer direction of the workpiece while pushing the upstream transferer against an end of the workpiece, the upstream transferer being located on an upstream side with respect to the press brake in the transfer direction, the end of the workpiece being an upstream end in the transfer direction; and supporting the workpiece from below by a support in conformity with a shape of the workpiece after pressing of the workpiece by the punch, and intermittently transferring the workpiece in the transfer direction, the support being located on a downstream side with respect to the press brake in the transfer direction.

24 Claims, 19 Drawing Sheets

Related U.S. Application Data

(60) Provisional application No. 63/165,927, filed on Mar. 25, 2021.

(56) References Cited

U.S. PATENT DOCUMENTS

| | | | | |
|---|---|---|---|---|
| 10,773,290 | B2 * | 9/2020 | Aigner | B21D 5/04 |
| 11,919,152 | B2 * | 3/2024 | Dal Lago | B25J 15/0616 |
| 12,325,092 | B2 * | 6/2025 | Kiefer | B23K 26/38 |

FOREIGN PATENT DOCUMENTS

| | | | |
|---|---|---|---|
| DE | 1124905 | B | 3/1962 |
| FR | 1296690 | A | 6/1962 |
| JP | H03-297516 | A | 12/1991 |
| JP | H08300045 | A | 11/1996 |
| JP | 10-94832 | A | 4/1998 |
| JP | 3504319 | B2 | 3/2004 |
| JP | 2019-081184 | A | 5/2019 |
| WO | 2020/089800 | A1 | 5/2020 |

OTHER PUBLICATIONS

Translation DE 4235192A1, Karls Apr. 1994.*
DE 102018133552A, Siebert Jun. 2020.*
Translation DE 102018133552A, Siebert Jun. 2020.*
CN 111318594A, Shi et al. Jun. 2020.*
Translation CN 111318594A, Shi et al. Jun. 2020.*
KR 102039978B1, Baek Nov. 2019.*
KR 101968603B1, Go et al. Apr. 2019.*
CN 111974888A, Chen Nov. 2020.*

* cited by examiner

WORKPIECE TRANSFER METHOD, WORKPIECE TRANSFER DEVICE, AND WORKPIECE TRANSFER PROGRAM

CROSS-REFERENCE TO RELATED APPLICATIONS

The present application is a bypass continuation of PCT Filing PCT/JP2022/014741, filed Mar. 25, 2022, which claims priority to U.S. 63/165,927, filed Mar. 25, 2021, both of which are incorporated by reference in their entirety.

BACKGROUND OF THE INVENTION

1. Field of the Invention

The present disclosure relates to a workpiece transfer method, a workpiece transfer device, and a workpiece transfer program.

2. Description of the Related Art

Conventionally, bending devices are known which perform bending of sheet materials. For example, Japanese Laid-Open Patent Application Publication No. H3-297516 discloses a bending device that uses a workpiece pusher to push a workpiece against a back gauge when transferring the workpiece to a given position. Japanese Laid-Open Patent Application Publication No. 2019-081184 discloses a bending device that secures supports to upstream and downstream ends of a workpiece in a transfer direction, that hooks a holder of an upstream mover on one of the supports, and that hooks a holder of a downstream mover on the other support. In this bending device, the workpiece is transferred by moving the movers with the holders hooked on the supports.

The bending device of Japanese Laid-Open Patent Application Publication No. H3-297516, which pushes a workpiece by the workpiece pusher until the workpiece reaches a given position, is disadvantageous in that when the bending device is used for incremental forming where transfer and pressing are repeated to form the workpiece into a desired shape, the accuracy of transfer to a given position decreases as the amount of bending increases with the progress of the forming process. The use of the bending device of Japanese Laid-Open Patent Application Publication No. 2019-081184 involves the step of securing the supports to a workpiece and the step of hooking the holders of the movers on the supports. There has been a demand for a simpler way of workpiece transfer.

SUMMARY OF THE INVENTION

A workpiece transfer method of the present disclosure is a workpiece transfer method for transferring a workpiece when bending of the workpiece is performed by a press brake including a die that supports the workpiece and a punch that is located above the die and presses the workpiece supported by the die, the workpiece transfer method including, before or after the bending: moving an upstream transferer in a transfer direction of the workpiece while pushing the upstream transferer against an end of the workpiece, the upstream transferer being located on an upstream side with respect to the press brake in the transfer direction, the end of the workpiece being an upstream end in the transfer direction; and supporting the workpiece from below by a support in conformity with a shape of the workpiece after pressing of the workpiece by the punch, and intermittently transferring the workpiece in the transfer direction, the support being located on a downstream side with respect to the press brake in the transfer direction.

A workpiece transfer device of the present disclosure is a workpiece transfer device that transfers a workpiece when bending of the workpiece is performed by a press brake including a die that supports the workpiece and a punch that is located above the die and presses the workpiece, the workpiece transfer device including: an upstream transferer that is located on an upstream side with respect to the press brake in a transfer direction of the workpiece; a transfer driver that moves the upstream transferer in the transfer direction; a support that is located on a downstream side with respect to the press brake in the transfer direction and that supports the workpiece from below in conformity with a shape of the workpiece after pressing of the workpiece by the punch; and control circuitry configure to, before or after the bending, control the transfer driver to intermittently transfer the workpiece in the transfer direction by moving the upstream transferer in the transfer direction while pushing the upstream transferer against an upstream end of the workpiece.

A workpiece transfer program of the present disclosure is a workpiece transfer program that runs on a computer in a workpiece transfer device that transfers a workpiece when bending of the workpiece is performed by a press brake including a die that supports the workpiece and a punch that is located above the die and presses the workpiece supported by the die, the workpiece transfer program being configured to allow the computer to function as transfer control means that, before or after the bending: moves an upstream transferer in a transfer direction of the workpiece while pushing the upstream transferer against an end of the workpiece, the upstream transferer being located on an upstream side with respect to the press brake in the transfer direction, the end of the workpiece being an upstream end in the transfer direction; and causes a support to support the workpiece from below in conformity with a shape of the workpiece after pressing of the workpiece by the punch, and intermittently transfers the workpiece in the transfer direction, the support being located on a downstream side with respect to the press brake in the transfer direction.

DETAILED DESCRIPTION

Hereinafter, a workpiece transfer method, a workpiece transfer device, and a workpiece transfer program according to one embodiment of the present disclosure will be described with reference to the drawings. The workpiece transfer method, workpiece transfer device, and workpiece transfer program described below are merely an exemplary embodiment of the present disclosure. The present disclosure is not limited to the embodiment described below, and additions, deletions, and changes may be made without departing from the gist of the present disclosure.

Figure 1:
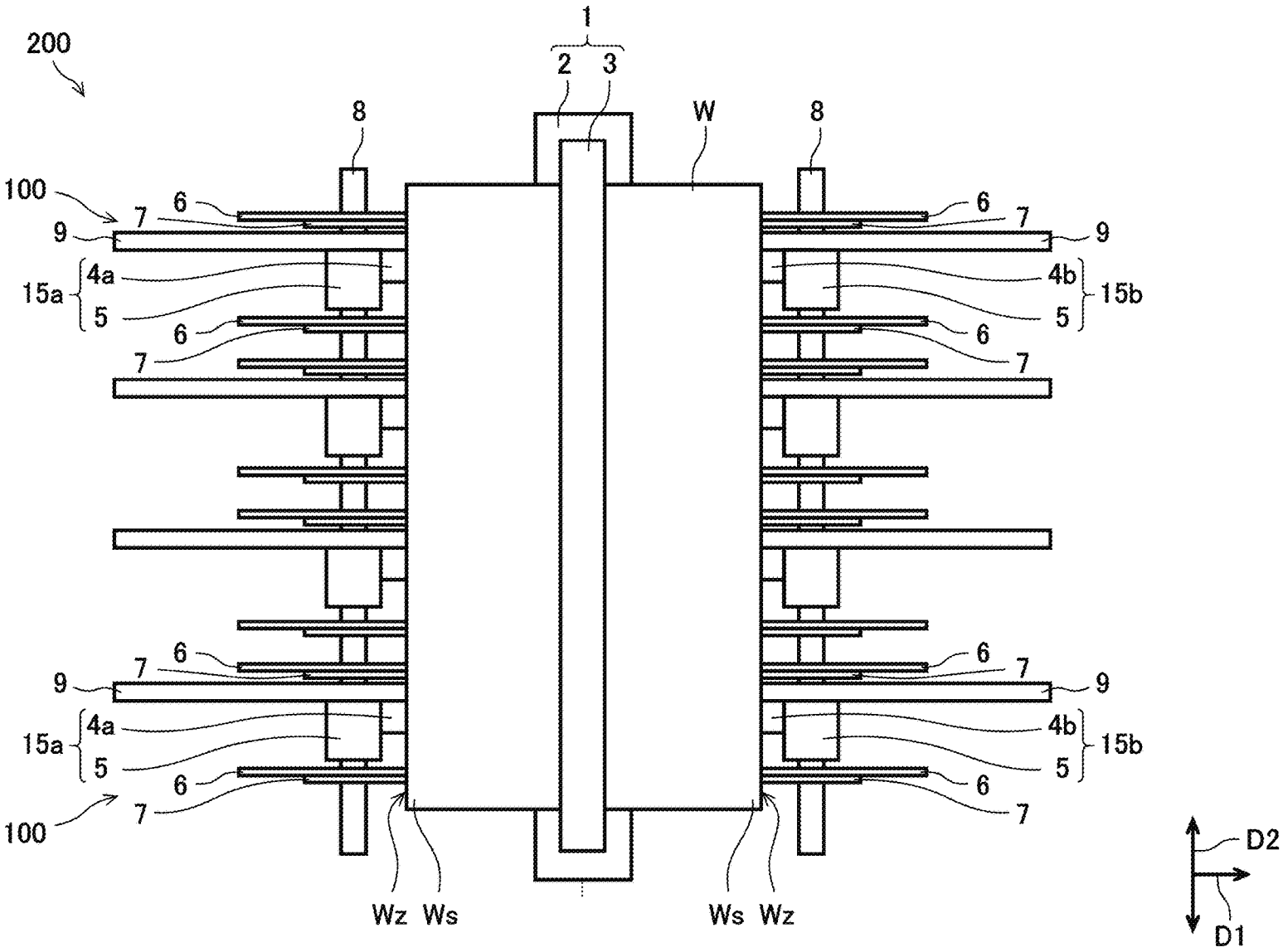
FIG. 1 is a plan view showing a bending system including workpiece transfer devices according to one embodiment of the present disclosure.
Figure 2:
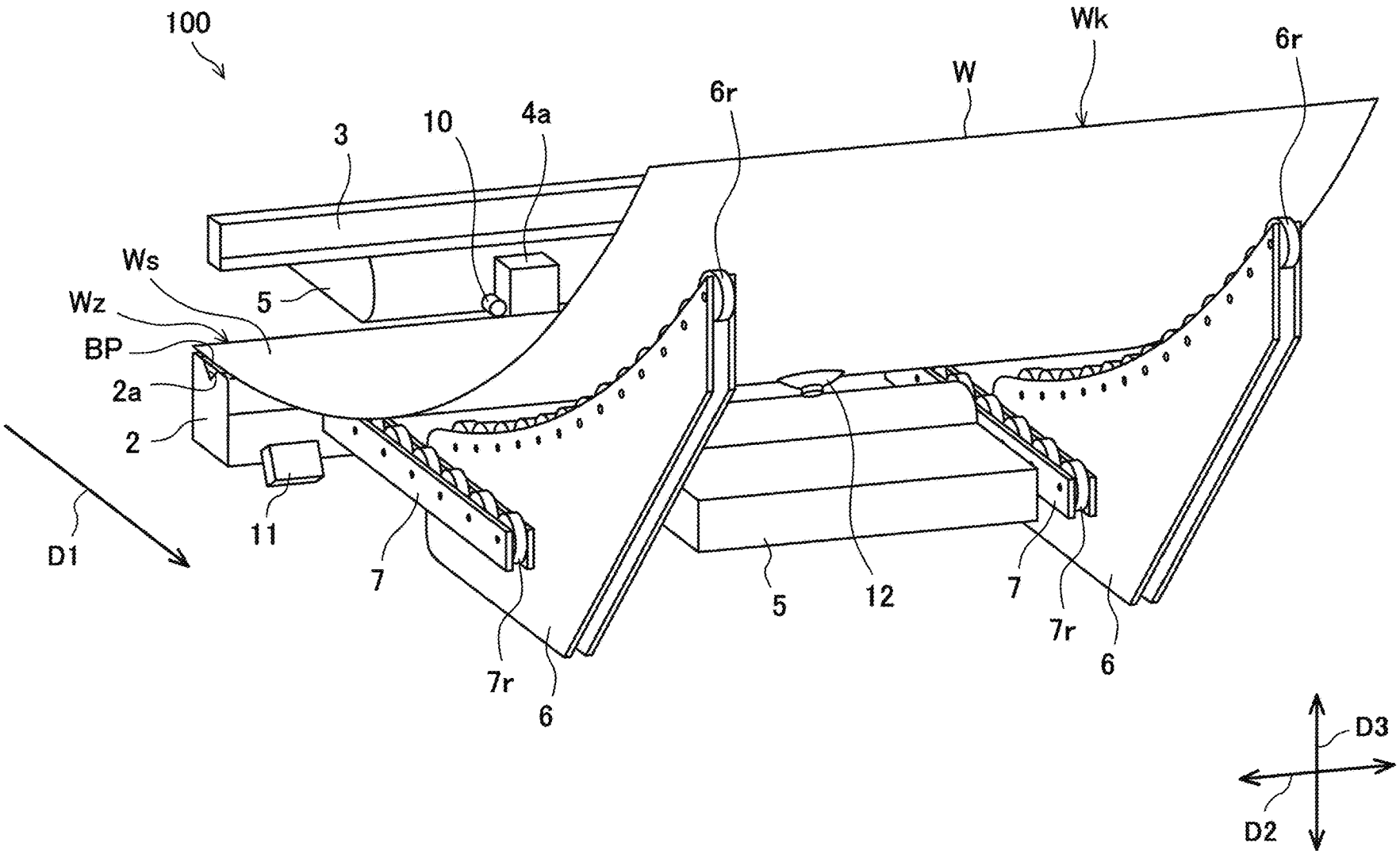
FIG. 2 is a perspective view showing the workpiece transfer device of FIG. 1 as viewed from the downstream side in the transfer direction.
Figure 3:
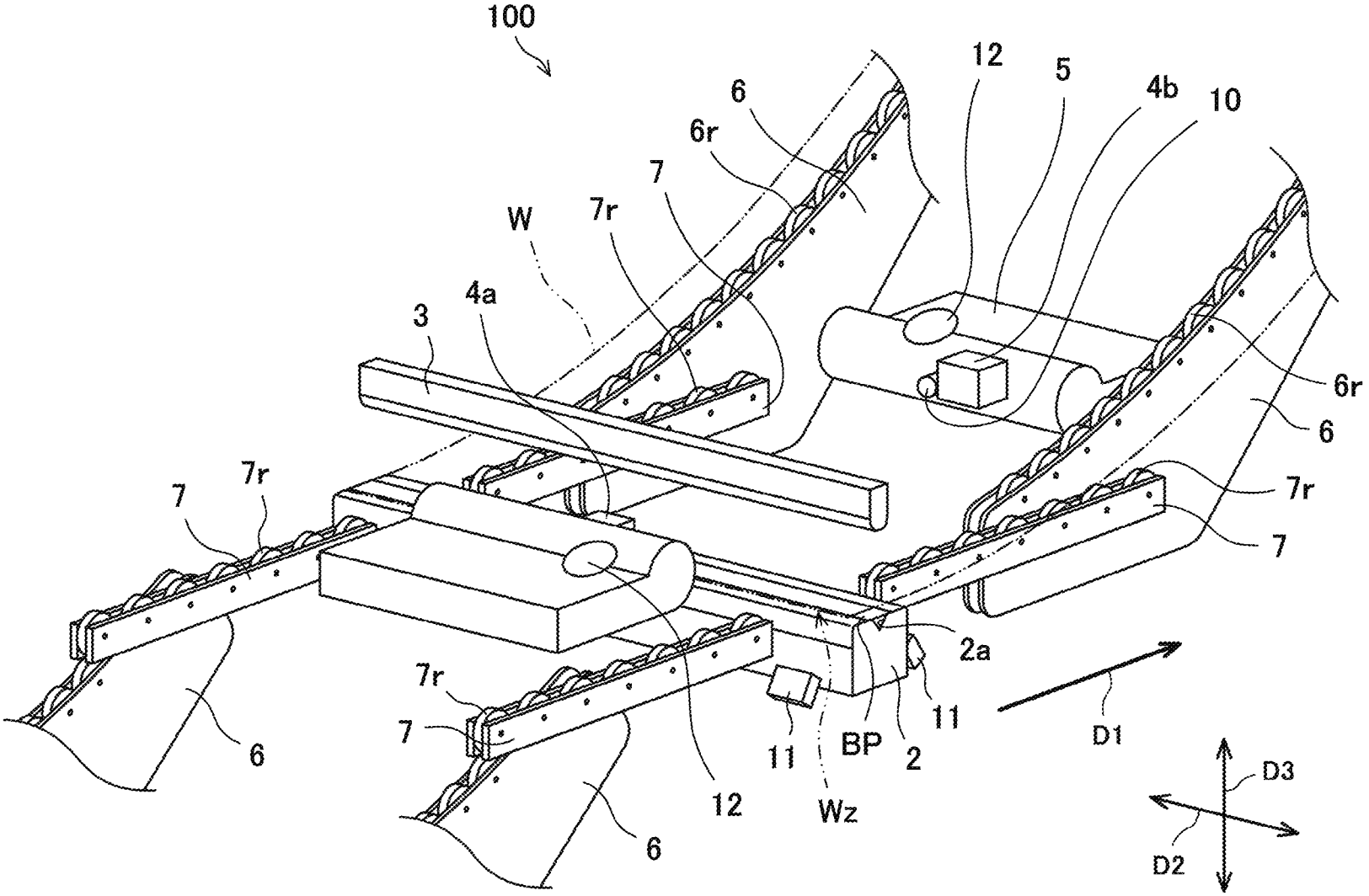
FIG. 3 is a perspective view showing the workpiece transfer device of FIG. 1 as viewed from the upstream side in the transfer direction.

FIG. 1 is a plan view showing a bending system 200 including workpiece transfer devices 100 according to one embodiment of the present disclosure. FIG. 2 is a perspective view showing the workpiece transfer device 100 of FIG. 1 as viewed from the downstream side in the transfer direction, and FIG. 3 is a perspective view showing the workpiece transfer device 100 of FIG. 1 as viewed from the upstream side in the transfer direction. In the following description, the transfer direction in which a workpiece W is transferred by the workpiece transfer device 100 is denoted by D1, and two directions perpendicular to the transfer direction D1 are referred to as a first perpendicular direction D2 and a second perpendicular direction D3, respectively. The second perpendicular direction D3 is, for example, an up-down direction, and the workpiece W is pressed in the second perpendicular direction D3. The first perpendicular direction D2 corresponds to a transverse direction.

The bending system 200 bends the flat sheet-shaped workpiece W into a given shape by repeating the step of transferring the workpiece W by a pitch in the transfer direction D1 and the step of pressing the workpiece W in the second perpendicular direction D3. As shown in FIG. 1, the bending system 200 includes: a press brake 1 including a die 2 as a lower mold and a punch 3 as an upper mold; and the workpiece transfer devices 100. Although FIG. 1 illustrates four workpiece transfer devices 100 arranged in the first perpendicular direction D2, only one workpiece transfer device 100 may be used, or five or more workpiece transfer devices 100 may be used.

Figure 4:
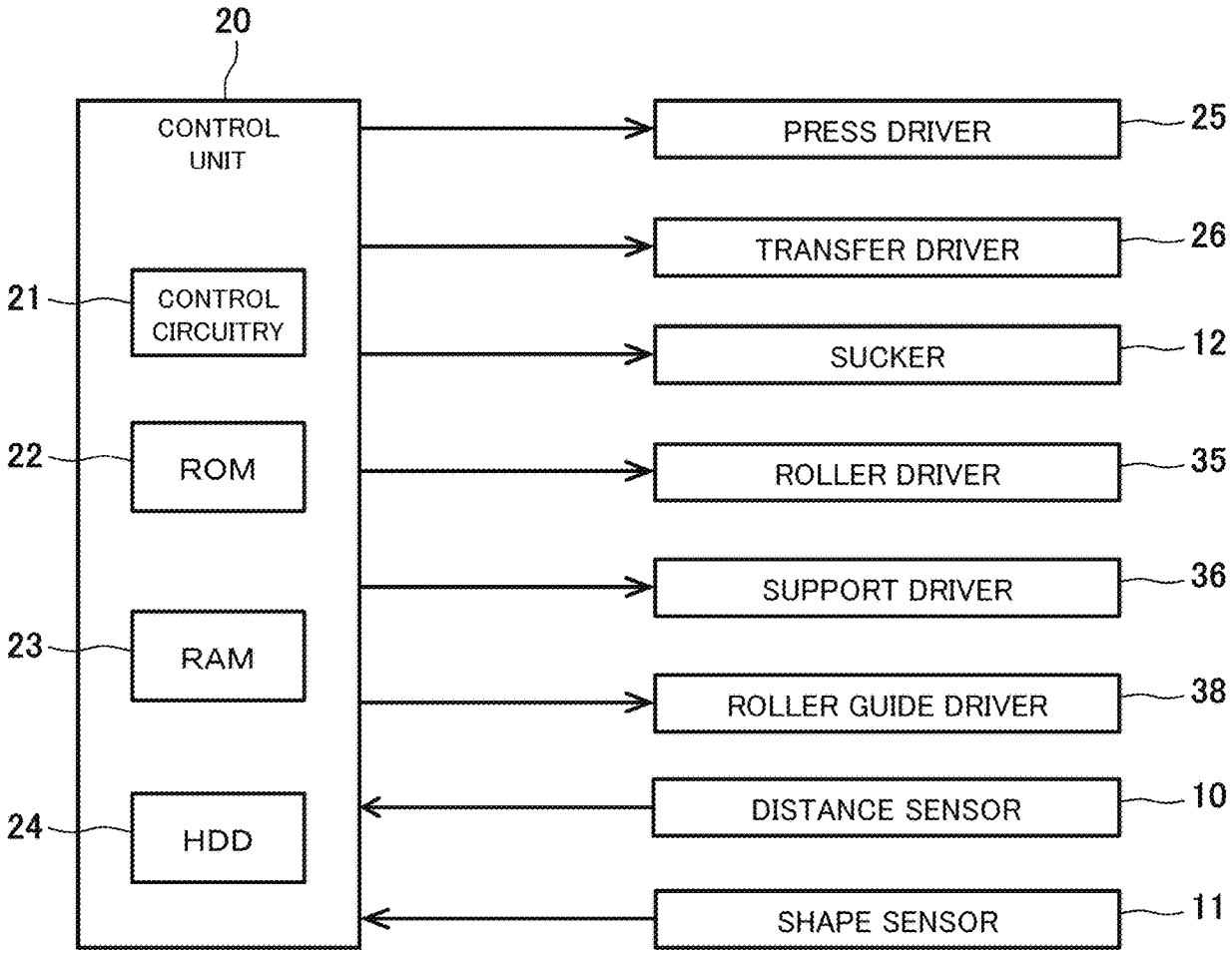
FIG. 4 is a block diagram showing a control system in the workpiece transfer device.

The die 2 extends in the first perpendicular direction D2. The upper edge of the die 2 is chamfered. At the top of the die 2 there is a groove 2*a*, and a backup plate BP is disposed to fill the groove 2*a*. The backup plate BP supports the workpiece W. The backup plate BP is designed not to be plastically deformed when pressed by the punch 3 with the workpiece W interposed between the backup plate BP and the punch 3. The die 2 supports the workpiece W. The punch 3 is located above the die 2. The punch 3 presses the workpiece W supported by the die 2. The punch 3 extends in the first perpendicular direction D2. In FIG. 4 and the subsequent figures, the groove 2*a* and the backup plate BP are omitted for the sake of simplicity.

The workpiece transfer devices 100 will be described. The workpiece transfer devices 100 all have the same configuration. Each of the workpiece transfer devices 100 includes: an upstream transferer 15*a* including a contact structure 4*a* and a holder 5; a downstream transferer 15*b* including a contact structure 4*b* and a holder 5; a support 6; a roller guide 7; a guide rail 8; and a guide rail 9.

The upstream transferer 15*a* is located on the upstream side with respect to the press brake 1 in the transfer direction D1. Each of the contact structures 4*a* and 4*b* is shaped as a block and made of, for example, a resin. The contact structure 4*a* contacts an upstream end Wz of the workpiece W. The contact structure 4*a* pushes the end Wz without gripping the end Wz. The contact structure 4*a* is held by the holder 5. The holder 5 is connected to a transfer driver 26 shown in FIG. 4. The holder 5 corresponds to a connector between the contact structure 4*a* and the transfer driver 26 and is made of, for example, a metal. The holder 5 rotates about an axis parallel to the first perpendicular direction D2. The side where there is the contact structure 4*a* or 4*b*, whichever is at a greater distance from the die 2 at the start of transfer toward the die 2 of the flat sheet-shaped workpiece W that has yet to be subjected to bending, is defined as the upstream side with respect to the press brake 1 in the transfer direction D1, and the opposite side is defined as the downstream side with respect to the press brake 1 in the transfer direction D1.

The downstream transferer 15*b* is located on the downstream side with respect to the press brake 1 in the transfer direction D1. The contact structure 4*b* contacts a downstream end Wk of the workpiece W. The contact structure 4*b* pushes the end Wk without gripping the end Wk. The contact structure 4*b* is held by the holder 5 of the downstream transferer 15*b*. The holder 5 is connected to the transfer driver 26.

The workpiece W is in the shape of a flat sheet before being pressed by the punch 3. Thus, when the flat sheet-shaped workpiece W is transferred by pushing it with the contact structure 4*a*, the contact structure 4*a* is in surface contact with the upstream end Wz of the workpiece W. During this transfer, the contact structure 4*a* is in surface contact with that upstream end face of the flat sheet-shaped workpiece W which crosses the workpiece W's surface that is to be pressed by the punch 3. Thus, in the present disclosure, the end Wz includes the upstream end face of the workpiece W.

In case that the workpiece W bent in an arc by pressing the workpiece W with the punch 3 (this bending may be referred to as "first bending" hereinafter) fails to attain a desired shape, additional bending (which may be referred to as "re-bending" hereinafter) may be performed by pressing the arc-shaped workpiece W again with the punch 3. In this case, the workpiece W having undergone the first bending is transferred by pushing it with the contact structures 4*a* and 4*b*. During this transfer, since the workpiece W having undergone the first bending is arc-shaped, the contact structure 4*a* is in surface contact with the upstream end face of the workpiece W which crosses the workpiece W's flat surface that is to be pressed by the punch 3 or in line contact with an edge constituting a part of the upstream end face. The contact structure 4*b* is in surface contact with the downstream end face of the workpiece W which crosses the workpiece W's flat surface that is to be pressed by the punch 3 or in line contact with an edge constituting a part of the downstream end face. Thus, in the present disclosure, the end Wz further includes the edge constituting a part of the upstream end face of the workpiece W. The end Wk includes the downstream end face of the workpiece W and the edge constituting a part of the downstream end face.

The support 6 supports the workpiece W while the workpiece W is being pressed or while the shape of the workpiece W is being measured. For example, two supports 6 are located on the upstream side in the transfer direction D1, and two supports 6 are located on the downstream side in the transfer direction D1. Alternatively, one support 6 or three or more supports 6 may be located on each of the upstream and downstream sides. The upstream supports 6 are spaced at a given distance from each other in the first perpendicular direction D2, and the downstream supports 6 are spaced at a given distance from each other in the first perpendicular direction D2.

Each support 6 includes rollers 6*r*. The upper edge of the support 6 is arc-shaped. The rollers 6*r* are arranged in an arc at the upper edge of the support 6 and spaced at a given distance from one another in the transfer direction D1. The rollers 6*r* are rotatably supported between two sheet materials that constitute the support 6 and that are spaced at a given distance from each other in the first perpendicular direction D2. Each of the rollers 6*r* is rotatable about an axis parallel to the first perpendicular direction D2. The rollers 6*r* rotate when contacted by the workpiece W. Preferably, a line connecting the upper edges of the rollers 6*r* to one another coincides with the contour shape of the workpiece W having undergone bending. The support 6 moves in a direction, such as the second perpendicular direction D3, toward or away from the workpiece W. The support 6 may pivot about a given pivot shaft parallel to the first perpendicular direction D2 instead of moving in a direction toward or away from the workpiece W. In the support 6, each of the rollers 6*r* may be movable by a motor or the like in the second perpendicular direction D3 instead of being rotatably supported between two sheet materials.

The roller guide 7 supports the workpiece W during transfer of the workpiece W. For example, two roller guides 7 are located on the upstream side in the transfer direction D1, and two roller guides 7 are located on the downstream side in the transfer direction D1. Alternatively, one roller guide 7 or three or more roller guides 7 may be located on each of the upstream and downstream sides. The downstream ends of the upstream roller guides 7 are located downstream of the downstream ends of the upstream supports 6. The upstream ends of the downstream roller guides 7 are located upstream of the upstream ends of the downstream supports 6. The upstream roller guides 7 are spaced at a given distance from each other in the first perpendicular direction D2, and the downstream roller guides 7 are spaced at a given distance from each other in the first perpendicular direction D2.

Each roller guide 7 extends in the transfer direction D1. The roller guide 7 includes rollers 7*r*. The rollers 7*r* are rotatably supported between two sheet materials that constitute the roller guide 7 and that are spaced at a given distance from each other in the first perpendicular direction D2. Each of the rollers 7*r* is rotatable about an axis parallel to the first perpendicular direction D2. The rollers 7*r* rotate when contacted by the workpiece W. The roller guide 7 pivots about a given pivot shaft parallel to the first perpendicular direction D2. The roller guide may be in any shape but is preferably flat.

The guide rail 9 is located on each of the upstream and downstream sides in the transfer direction D1. The guide rail 9 extends in the transfer direction D1. The guide rail 9 supports the holder 5 from below and guides the holder 5 in the transfer direction D1 and a direction opposite to the transfer direction D1. Thus, the contact structures 4*a* and 4*b* move in the transfer direction D1 and the direction opposite to the transfer direction D1.

The guide rail 8 is located on each of the upstream and downstream sides in the transfer direction D1. The guide rail 8 extends in the first perpendicular direction D2. The guide rail 8 supports the guide rail 9 from below and guides the guide rail 9 and the holder 5 supported by the guide rail 9 in the first perpendicular direction D2. Thus, the contact structure 4*a* and 4*b* move in the first perpendicular direction D2.

As shown in FIGS. 2 and 3, a distance sensor 10 is mounted on the contact structure 4*a*. The distance sensor 10 detects the distance between the contact structure 4*a* and the upstream end Wz of the workpiece W. If the distance detected by the distance sensor 10 is 0, this means that the contact structure 4*a* is in contact with the end Wz. The distance sensor 10 is, for example, a proximity sensor, a laser range sensor, or an image sensor. In the case where an image sensor is used as the distance sensor 10, the size of the end Wz or Wk of the workpiece W in the image captured by the image sensor can be acquired as distance-related information (without calculating the distance directly). Thus, the distance-related information is not limited to distance information directly acquired but includes information from which the distance can be estimated indirectly.

A distance sensor 10 is mounted on the contact structure 4*b*. The distance sensor 10 mounted on the contact structure 4*b* detects the distance between the contact structure 4*b* and the downstream end Wk of the workpiece W. In FIG. 3, the workpiece W is shown by a dashed-double dotted line to clearly show the constituent elements of the transfer device 100.

The workpiece transfer device 100 includes shape sensors 11. The shape sensors 11 are located in proximity to the die 2. Specifically, the shape sensors 11 are located below the workpiece W supported by the die 2. Some of the shape sensors 11 are located on the upstream side in the transfer direction D1 and spaced at a given distance from one another in the first perpendicular direction D2. The other shape sensors 11 are located on the downstream side in the transfer direction D1 and spaced at a given distance from one another in the first perpendicular direction D2. Each of the shape sensors 11 is, for example, a proximity sensor, a laser range sensor, a contact sensor, or an image sensor. Each of the shape sensors 11 acquires a parameter related to the shape of the workpiece W. Specifically, each of the shape sensors 11 acquires an angle (e.g., an angle relative to a horizontal plane) or a curvature of that portion of the workpiece W which has been pressed by the punch 3.

A sucker 12 is mounted on each of the upstream and downstream transferers 15*a* and 15*b*. The sucker 12 sucks and holds the workpiece W. Examples of the way of suction by the sucker 12 include air or electromagnetic suction using a suction cup.

FIG. 4 is a block diagram showing a control system in the workpiece transfer device 100. As shown in FIG. 4, the workpiece transfer device 100 includes a control unit 20, a press driver 25, a transfer driver 26, a roller driver 35, a support driver 36, and a roller guide driver 38.

The control unit 20 includes control circuitry 21 embodied as a CPU (Central Processing Unit), a ROM (Read Only Memory) 22, a RAM (Random Access Memory) 23, and an HDD (Hard Disk Drive) 24. The ROM 22 stores various pieces of information such as target positions to which the contact structures 4*a* and 4*b* are moved at the time of transfer of the workpiece W. The target positons are those defined based on information about the contour R of the workpiece W to be shaped by bending and include different positions of the workpiece W in the transfer direction D1 and heights associated with the different positions. The RAM 23 is used as a processing region for the control circuitry 21. The control circuitry 21 corresponds to transfer control means, and the ROM 22, RAM 23, and HDD 24 together correspond to a storage.

The HDD 24 stores a workpiece transfer program for operating the workpiece transfer device 100 of the present disclosure. The workpiece transfer program may be received from an external device and stored into the HDD 24 or may be retrieved from a computer-readable recording medium (such as a DVD-ROM or USB flash memory) recording the workpiece transfer program and stored into the HDD 24.

The control circuitry 21 controls the operation of the press driver 25 to press the punch 3 against the workpiece W by a given stroke. After the pressing of the workpiece W, the control circuitry 21 controls the operation of the press driver 25 to move the punch 3 away from the workpiece W. The press driver 25 includes, for example, a motor and a hydraulic cylinder.

The control circuitry 21 controls the operation of the transfer driver 26 to move the contact structure 4*a* or 4*b* in the transfer direction D1, the first perpendicular direction D2, and the second perpendicular direction D3 based on the target position. The details of the transfer driver 26 will be described later. The control circuitry 21 controls the operation of the suckers 12 to suck and hold the workpiece W.

The control circuitry 21 controls the operation of the roller driver 35 to move the roller 6*r* of the support 6 in a direction toward or away from the workpiece W. The control circuitry 21 controls the operation of the support driver 36 to cause the support 6 to pivot about a given pivot shaft. The control circuitry 21 controls the operation of the roller guide driver 38 to cause the roller guide 7 to pivot about a given pivot shaft. The workpiece transfer device 100 may include either or both of the roller driver 35 and the support driver 36.

The control circuitry 21 receives information on the distance between the contact structure 4*a* and the upstream end Wz of the workpiece W from the distance sensor 10 located on the upstream side in the transfer direction D1. The control circuitry 21 receives information on the distance between the contact structure 4*b* and the downstream end Wk of the workpiece W from the distance sensor 10 located on the downstream side in the transfer direction D1. The control circuitry 21 changes the operation of the punch 3 and the operation of the transfer driver 26 in accordance with the distance detected by each distance sensor 10. Specifically, for example, the control circuitry 21 stops the operation of the punch 3 and the operation of the transfer driver 26 in case that the distance detected by the distance sensor 10 is greater than an acceptable limit, namely in case that there is an unacceptably large gap between the workpiece W and the contact structure 4*a* or 4*b*.

The control circuitry 21 receives information on the angle or curvature of the pressed portion of the workpiece W from each of the shape sensors 11. For example, in an abnormal situation where the angle or curvature of the pressed portion of the workpiece W is outside a given range, the control circuitry 21 may stop the operation of the punch 3 and the operation of the transfer driver 26.

Figure 5:
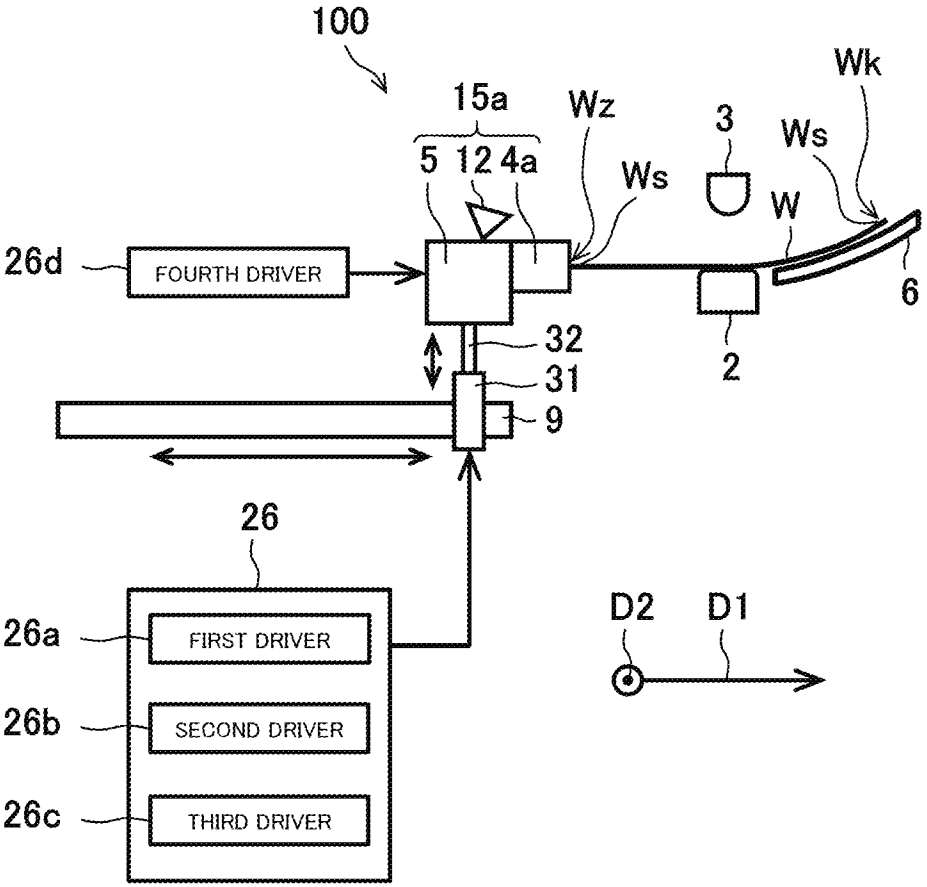
FIG. 5 is a schematic diagram showing an upstream transferer pushing a workpiece in first bending.
Figure 6:
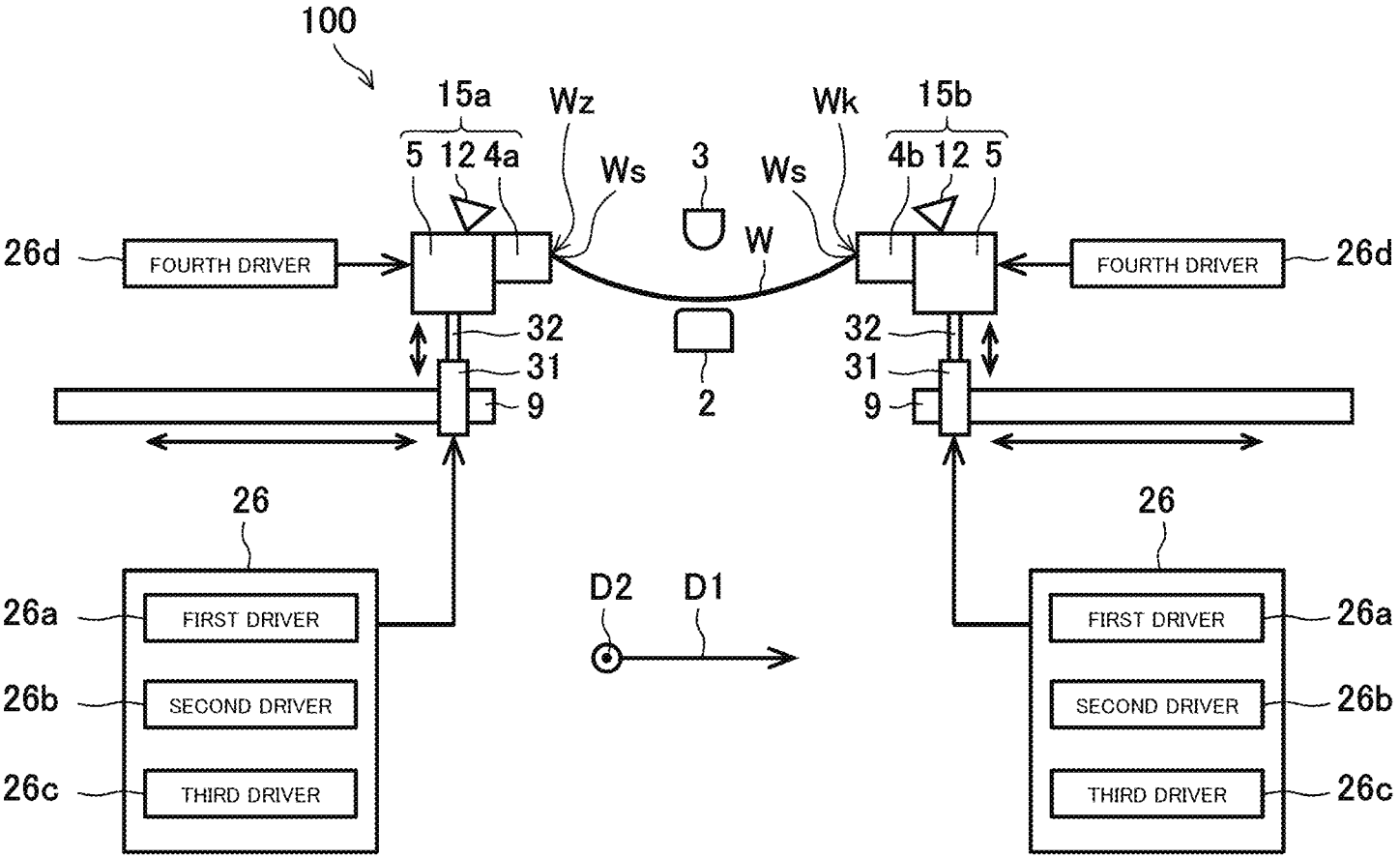
FIG. 6 is a schematic diagram showing upstream and downstream transferers pushing the workpiece in re-bending.

FIG. 5 is a schematic diagram showing the upstream transferer 15*a* pushing the workpiece W in the first bending. FIG. 6 is a schematic diagram showing the upstream and downstream transferers 15*a* and 15*b* as viewed immediately before or after the upstream and downstream transferers 15*a* and 15*b* push the workpiece W in the re-bending. In FIG. 5, the downstream transferer 15*b* and the transfer driver 26 that drives the downstream transferer 15*b* are omitted.

The transfer driver 26 that drives the upstream transferer 15*a* and the transfer driver 26 that drives the downstream transferer 15*b* have the same configuration. The configuration of the transfer driver 26 that drives the upstream transferer 15*a* will be described below as a representative. The transfer driver 26 includes a first driver 26*a*, a second driver 26*b*, a third driver 26*c*, and a fourth driver 26*d*. A slide structure 31 and a raising/lowering structure 32 are coupled to the holder 5. The raising/lowering structure 32 is, for example, a ball screw and driven by the first driver 26*a* which is a drive source such as a motor. The raising/lowering structure 32 is raised or lowered by the first driver 26*a*. Thus, the holder 5 is raised or lowered, and accordingly the contact structure 4*a* is also raised or lowered.

The slide structure 31 is, for example, a ball screw and driven by the second driver 26*b* which is a drive source such as a motor. The second driver 26*b* causes the slide structure 31 to slide along the guide rail 9. Thus, the holder 5 slides along the guide rail 9, and accordingly the contact structure 4*a* moves in the transfer direction D1 or in the direction opposite to the transfer direction D1. The third driver 26*c* is, for example, a drive source such as a motor and causes the slide structure 31 and the guide rail 9 to slide along the guide rail 8. Thus, the holder 5 slides along the guide rail 8, and accordingly the contact structure 4*a* moves in the first perpendicular direction D2.

The fourth driver 26*d* is, for example, a drive source such as a motor and causes a rotational shaft included in the holder 5 to rotate about an axis parallel to the first perpendicular direction D2. Thus, the sucker 12 rotates about an axis parallel to the first perpendicular direction D2. The sucker 12 is rotated in accordance with the shape of the workpiece W and sucks the workpiece W.

When starting transfer of the workpiece W for the first bending, the first, second, and third drivers 26*a*, 26*b*, and 26*c* move the contact structure 4*a* to a given position in accordance with instructions from the control circuitry 21. Thus, the contact structure 4*a* is placed away from and facing the end Wz of the workpiece W in the transfer direction D1. After this state is established, the second driver 26*b* moves the contact structure 4*a* in the transfer direction D1 in accordance with an instruction from the control circuitry 21 to bring the contact structure 4*a* into contact with the end Wz of the workpiece W. Subsequently, the second driver 26*b* causes the contact structure 4*a* to push the end Wz of the workpiece W and move the workpiece W to a position defined by the workpiece transfer program. In this manner, the workpiece W is transferred in the transfer direction D1.

When starting transfer of the workpiece W for the re-bending, the first, second, and third drivers 26*a*, 26*b*, and 26*c* move the contact structures 4*a* and 4*b* to given positions in accordance with instructions from the control circuitry 21. In the re-bending, the contact structures 4*a* and 4*b* move also in the second perpendicular direction D3 since the workpiece W has the contour R. Tus, the contact structure 4*a* is placed away from and facing the end Wz of the workpiece W in the transfer direction D1, and the contact structure 4*b* is placed away from and facing the end Wk of the workpiece W in the transfer direction D1. After this state is established, the second driver 26*b* moves the contact structure 4*a* in the transfer direction D1 in accordance with an instruction from the control circuitry 21 to bring the contact structure 4*a* into contact with the end Wz of the workpiece W. Subsequently, the second driver 26*b* causes the contact structure 4*a* to push the end Wz of the workpiece W and move the workpiece W to a position defined by the workpiece transfer program. Next, the second driver 26*b* moves the contact structure 4*b* in the direction opposite to the transfer direction D1 in accordance with an instruction from the control circuitry 21 to bring the contact structure 4*b* into contact with the end Wk of the workpiece W located at the position defined by the workpiece transfer program. In this manner, the end Wz of the workpiece W is pushed by the contact structure 4*a*, and the end Wk of the workpiece W is contacted by the contact structure 4*b*. Thus, the workpiece W can be accurately positioned by the contact structures 4*a* and 4*b* while being transferred.

Figure 7:
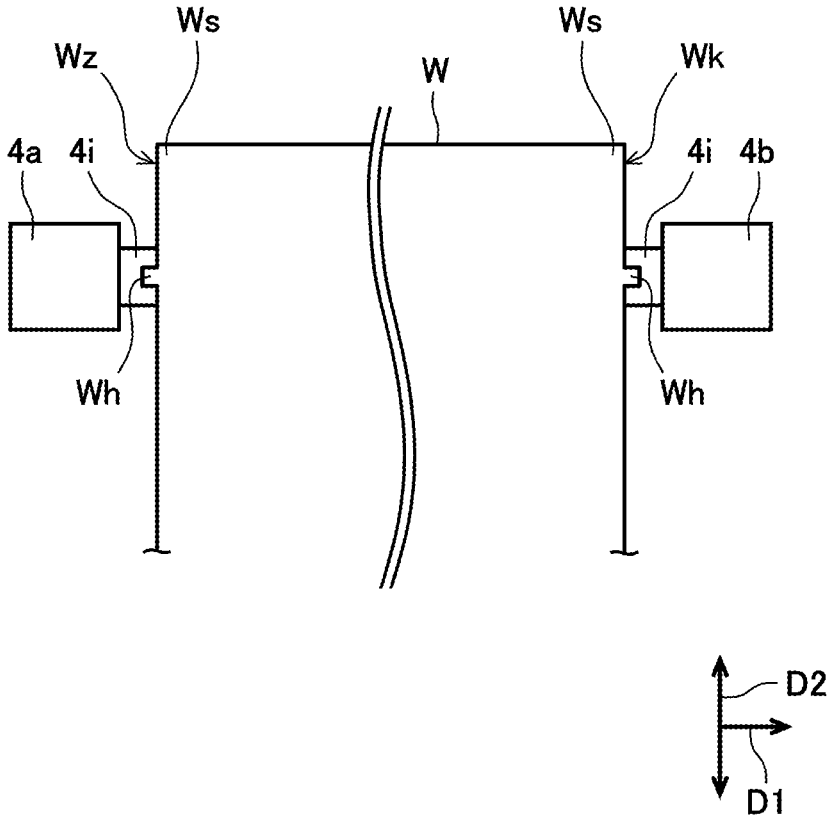
FIG. 7 shows a state where positioning locks of contact structures are in engagement with lock receivers of the workpiece.

FIG. 7 shows a state where positioning locks 4*i* of the contact structures 4*a* and 4*b* are in engagement with lock receivers Wh of the workpiece W.

As shown in FIG. 7, lock receivers Wh may be located at both the upstream and downstream ends Wz and Wk of the workpiece W in the transfer direction D1. Two or more lock receivers Wh may be located at each of the ends Wz and Wk of the workpiece W. For example, the lock receivers Wh are shaped as protrusions extending outward from the ends Wz and Wk.

A positioning lock 4*i* is located on each of the contact structures 4*a* and 4*b*. The engagement of the positioning locks 4*i* with the lock receivers Wh can ensure accurate positioning of the workpiece W in the first perpendicular direction D2.

The number and arrangement of the positioning locks 4*i* are determined in accordance with the number and arrangement of the lock receivers Wh of the workpiece W. The positioning locks 4*i* are shaped, for example, to have a recess. Although in the shown example the lock receivers Wh are shaped as protrusions and the positioning locks 4*i* are shaped to have a recess, this is not limiting. The lock receivers Wh may be shaped as recesses, and the positioning locks 4*i* may be shaped to have a protrusion. Each of the positioning locks 4*i* may be shaped to have two or more recesses, and each of the lock receivers Wh may include two or more protrusions. Each of the positioning locks 4*i* may be shaped to have two or more protrusions, and each of the lock receivers Wh may include two or more recesses.

Figure 8A:
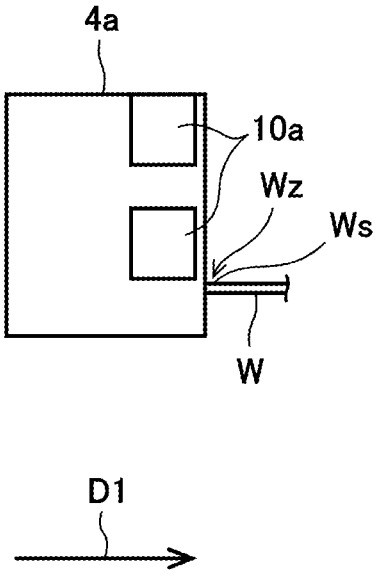
FIG. 8A is a side view showing the arrangement of distance sensors.
Figure 8B:
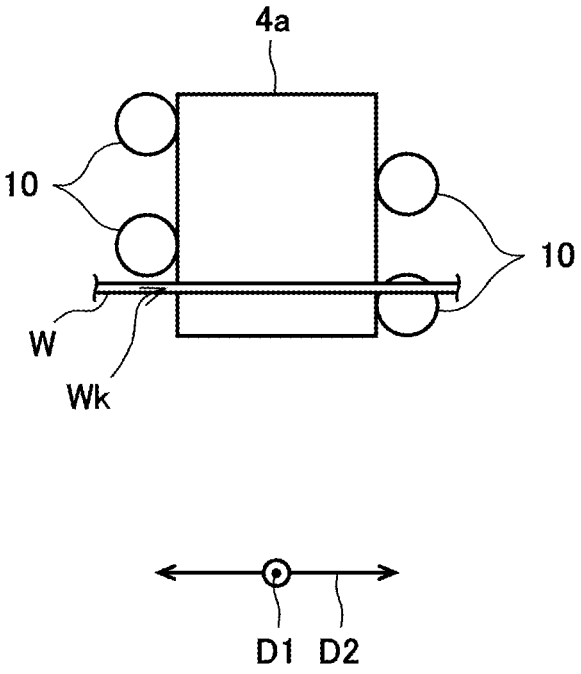
FIG. 8B is a front view showing the arrangement of the distance sensors.
Figure 9:
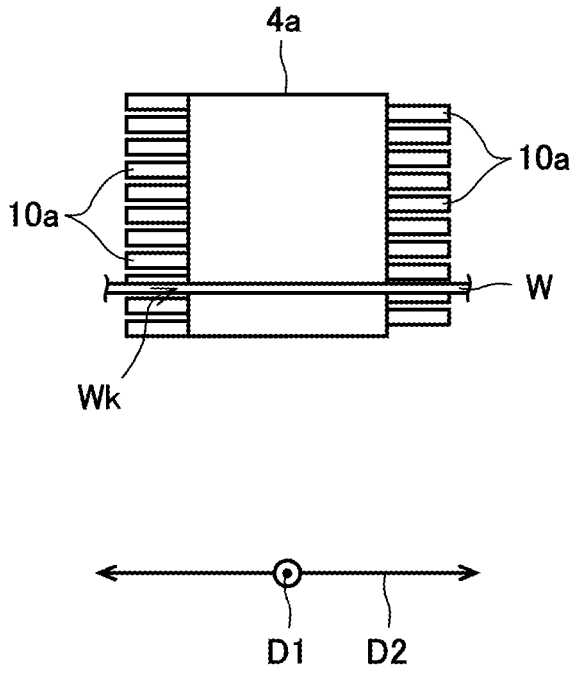
FIG. 9 is a front view showing the arrangement of distance sensors according to another example.

FIG. 8A is a side view showing the arrangement of the distance sensors 10, and FIG. 8B is a front view showing the arrangement of the distance sensors 10. FIG. 9 is a front view showing the arrangement of distance sensors 10*a* according to another example.

As shown in FIGS. 8A and 8B, one or more distance sensors 10 are mounted on the contact structure 4*a*. The distance sensors 10 are mounted on those surfaces of the contact structure 4*a* which cross the contact structure 4*a*'s surface that faces the end Wz of the workpiece W. That is, the distance sensors 10 are mounted on both of the side surfaces of the contact structure 4*a*. The same is true of the distance sensors 10 mounted on the contact structure 4*b*. Examples of the distance sensors 10 include proximity sensors and laser range sensors. In the case where the distance sensors 10 are proximity sensors, the distance sensors 10 are arranged at different heights so that the range over which the point of contact of the end Wz of the workpiece W with the contact structure 4*a* is detectable may be broadened in the height direction. If one distance sensor 10 is sufficient to cover the necessary detection range in the height direction, only one distance sensor 10 may be used. If the detection range covered by two or more distance sensors 10 arranged in the height direction is free of any zone where the workpiece W is undetectable, the distance sensors 10 need not be mounted on both of the side surfaces of the contact structure 4*a*.

In another example, the distance sensor 10 used may be a distance sensor 10*a* that is a laser range sensor. As shown in FIG. 9, two or more distance sensors 10*a* are mounted on the contact structure 4*a*. The distance sensors 10*a* are mounted on those surfaces of the contact structure 4*a* which cross the contact structure 4*a*'s surface that faces the end Wz of the workpiece W. That is, the distance sensors 10*a* are mounted on both of the side surfaces of the contact structure 4*a*. The same is true of the distance sensors 10*a* mounted on the contact structure 4*b*. The distance sensors 10*a* are arranged to let their light sources emit lasers at different heights so that the range over which the point of contact of the end Wz of the workpiece W with the contact structure 4*a* is detectable may be broadened in the height direction. By virtue of the above-described arrangement of the distance sensors 10, the distance between the contact structure 4*a* or 4*b* and the end Wz or Wk of the workpiece W or information on the distance between the contact structure 4*a* or 4*b* and the end Wz or Wk of the workpiece W can be detected regardless of which portion of the contact structure 4*a* or 4*b* the end Wz or Wk of the workpiece W comes close to. If one distance sensor 10 is sufficient to cover the necessary detection range in the height direction, only one distance sensor 10 may be used. If the detection range covered by two or more distance sensors 10 arranged in the height direction is free of any zone where the workpiece W is undetectable, the distance sensors 10 need not be mounted on both of the side surfaces of the contact structure 4*a*.

Figure 10:
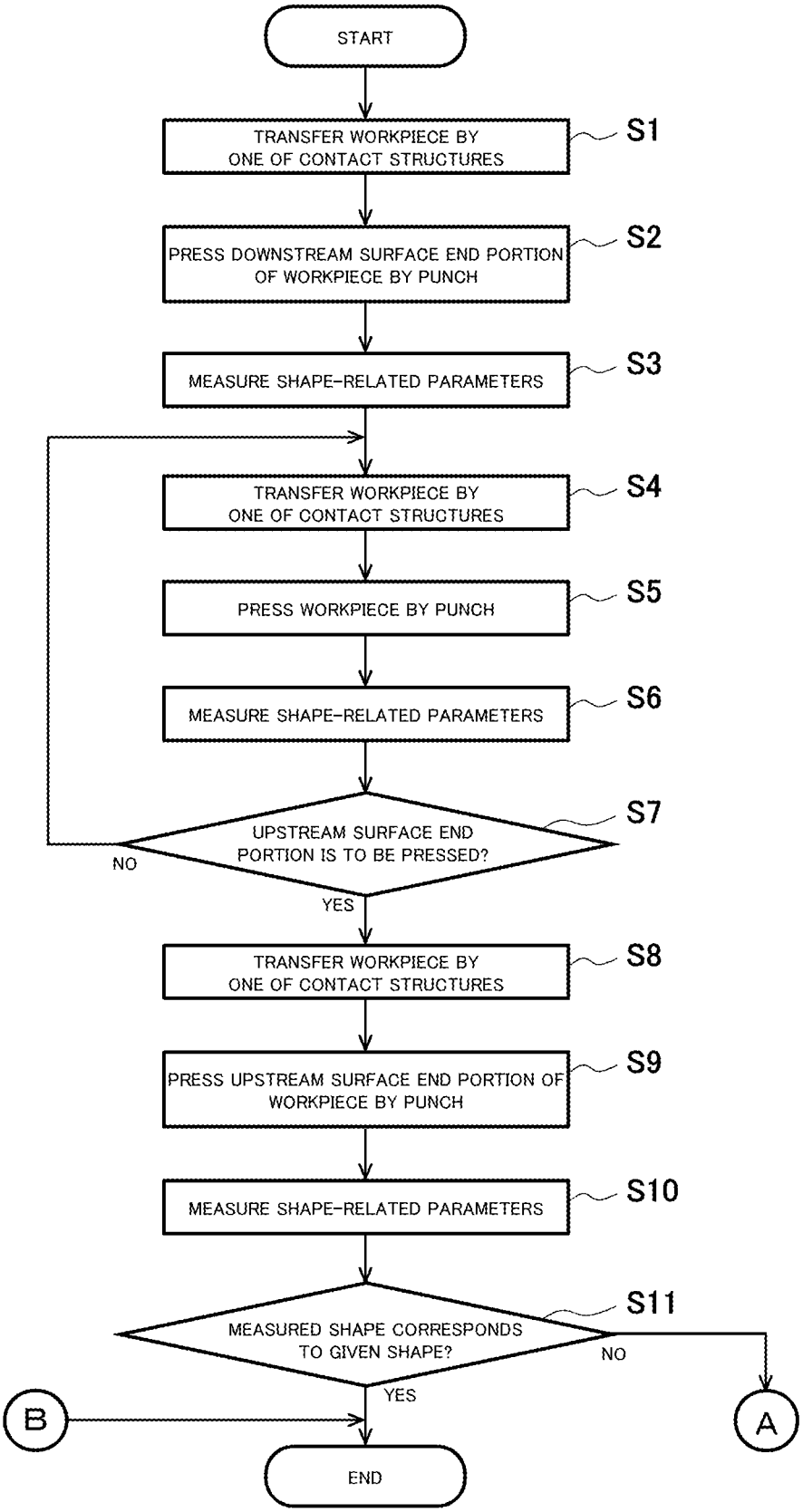
FIG. 10 is a flowchart showing the flow of the process of bending.
Figure 11:
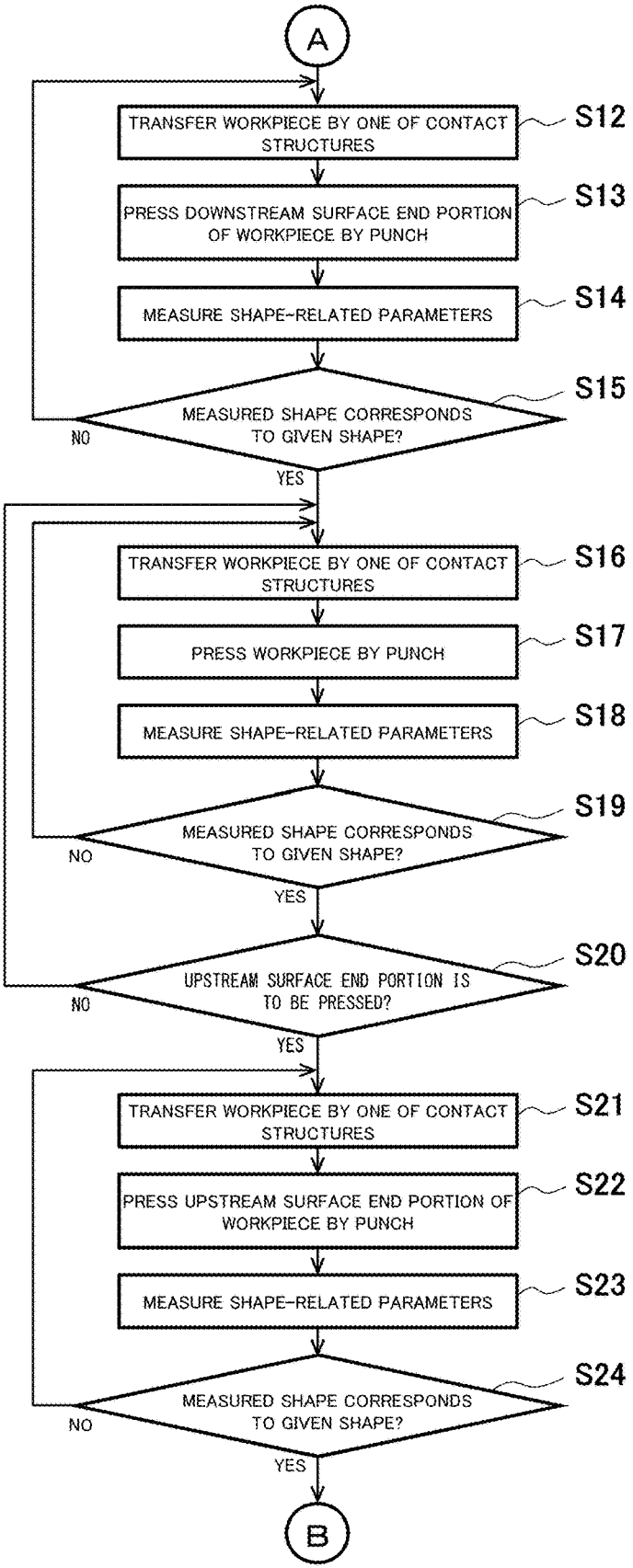
FIG. 11 is a flowchart showing the flow of the process of bending.

FIGS. 10 and 11 are flowcharts showing the flow of the process of bending. As shown in FIG. 10, the flat sheet-shaped workpiece W that has yet to be shaped by bending is pushed by the contact structure 4*a* of the upstream transferer 15*a* to transfer the workpiece W from the upstream side toward the downstream side such that a downstream surface end portion Ws of the workpiece W is placed at a given position on the die 2 (step S1). In this transfer, the control circuitry 21 moves the downstream supports 6 to positions where the downstream supports 6 support the workpiece W, and moves the upstream supports 6 to positions where the upstream supports 6 do not support the workpiece W. During transfer and bending of the workpiece W, the control circuitry 21 may change the operation of the punch 3 and the operation of the transfer drivers 26 in accordance with the distances detected by the distance sensors 10; for example, the control circuitry 21 may stop the operation of the punch 3 and the operation of the transfer drivers 26.

The control circuitry 21 causes the punch 3 to press the downstream surface end portion Ws of the workpiece W while keeping the upstream end Wz of the workpiece W in contact with the contact structure 4*a* of the upstream transferer 15*a* (step S2). In the present disclosure, the "surface end portion Ws" refers to that upstream or downstream region of the surface of the workpiece W where the punch 3 and the contact structure 4*a* or 4*b* could interfere with each other during pressing by the punch 3.

Next, the control circuitry 21 causes the contact structure 4*a* of the upstream transferer 15*a* to push the end Wz of the workpiece W and transfer the workpiece W to a given measurement position to measure the shape of the pressed downstream surface end portion Ws and, after that, calculates parameters related to the shape of the pressed portion of the workpiece W based on results of detection by the shape sensors 11 (step S3). Subsequently, the control circuitry 21 causes the contact structure 4*a* to push the end Wz of the workpiece W and transfer the workpiece W to a given position (step S4). The control circuitry 21 causes the punch 3 to press the workpiece W (step S5). The control circuitry 21 then causes the contact structure 4*a* of the upstream transferer 15*a* to push the end Wz of the workpiece W and transfer the workpiece W to a given measurement position and, after that, calculates parameters related to the shape of the pressed portion of the workpiece W based on results of detection by the shape sensors 11 (step S6).

In case that the portion to be subsequently pressed by the punch 3 is determined not to be the upstream surface end portion Ws based on the workpiece transfer program (NO in step S7), the control circuitry 21 returns to step S4 and repeats the subsequent steps. In case that the portion to be subsequently pressed by the punch 3 is determined to be the upstream surface end portion Ws based on the workpiece transfer program (YES in step S7), the control circuitry 21 causes the contact structure 4*a* to push the end Wz of the workpiece W and transfer the workpiece W such that the upstream surface end portion Ws of the workpiece W is placed at a given position on the die 2 (step S8).

The control circuitry 21 causes the contact structure 4*a* to withdraw from the workpiece W while causing the sucker 12 of the downstream transferer 15*b* to suck and hold the workpiece W and, after that, causes the punch 3 to press the upstream surface end portion Ws of the workpiece W (step S9). Next, the control circuitry 21 causes the workpiece W to be transferred to a given measurement position in the direction opposite to the transfer direction D1, and then calculates parameters related to the shape of the pressed portion of the workpiece W based on results of detection by the shape sensors 11 located upstream of the die 2 (step S10).

Subsequently, the control circuitry 21 determines whether the workpiece W has a given shape (step S11). The control circuitry 21 can make the determination of whether the workpiece W has the given shape based on the calculated parameters related to the pressed portions of the workpiece W. In case that the workpiece W has the given shape (YES in step S11), the control circuitry 21 ends the process of bending.

In case that the workpiece W does not have the given shape (NO in step S11), the control circuitry 21 carries out re-bending of the workpiece W as described below. The process described below is one where the downstream surface end portion Ws of the workpiece W, the upstream surface end portion Ws of the workpiece W, and the rest of the surface of the workpiece W (the region of the surface that is other than the downstream and upstream surface end portions Ws) are all subjected to re-bending. Depending on the shape measurement results, re-bending of the downstream or upstream surface end portion Ws or the rest of the surface of the workpiece W may be skipped.

First, the control circuitry 21 causes the contact structure 4*b* to push the end Wk of the workpiece W formed in an arch shape by the first bending and transfer the workpiece W to a given position in the direction opposite to the transfer direction D1 and, after that, causes the contact structure 4*a* of the upstream transferer 15*a* to transfer the workpiece W from the upstream side toward the downstream side such that the downstream surface end portion Ws of the workpiece W is placed at a given position on the die 2 (step S12). During transfer and bending of the workpiece W, the control circuitry 21 may change the operation of the punch 3 and the operation of the transfer drivers 26 in accordance with the distances detected by the distance sensors 10; for example, the control circuitry 21 may stop the operation of the punch 3 and the operation of the transfer drivers 26.

In case that the region of the workpiece W that is to be pressed in the re-bending is the downstream surface end portion Ws of the workpiece W, the control circuitry 21 causes the sucker 12 of the upstream transferer 15*a* to suck and hold the workpiece W and causes the contact structure 4*b* to withdraw from the workpiece W and, after that, causes the punch 3 to press the downstream surface end portion Ws of the workpiece W (step S13). Next, the control circuitry 21 causes the contact structure 4*a* to transfer the workpiece W to a given measurement position and then calculates parameters related to the shape of the pressed portion of the workpiece W based on results of detection by the shape sensors 11 (step S14).

Subsequently, the control circuitry 21 determines whether the workpiece W has a given shape (step S15). In case that the workpiece W does not have the given shape (NO in step S15), the control circuitry 21 causes the contact structure 4*b* to push back the workpiece W (step S12) and then repeats step S13 and the subsequent steps.

In case that the workpiece W has the given shape (YES in step S15) and the region of the workpiece W that is to be subsequently pressed in the re-bending is between the downstream and upstream surface end portions Ws of the workpiece W, the control circuitry 21 causes the contact structure 4*b* to move in the transfer direction D1 and be on standby at a given position. Next, the control circuitry 21 causes the contact structure 4*a* to push the end Wz of the workpiece W and transfer the workpiece W such that the workpiece W is placed at a given position on the die 2. Subsequently, the control circuitry 21 causes the contact structure 4*b* to move in the direction opposite to the transfer direction D1 and come into contact with the end Wk of the workpiece W (step S16). The control circuitry 21 then causes the punch 3 to press the workpiece W with its end faces held between the contact structures 4*a* and 4*b* (step S17). The control circuitry 21 causes the workpiece W to be transferred to a given measurement position and then calculates parameters related to the shape of the pressed portion of the workpiece W based on results of detection by the shape sensors 11 (step S18).

Subsequently, the control circuitry 21 determines whether the workpiece W has a given shape (step S19). In case that the workpiece W does not have the given shape (NO in step S19), the control circuitry 21 causes the contact structure 4*a* to move in the direction opposite to the transfer direction D1 and be on standby at a given position. Next, the control circuitry 21 causes the contact structure 4*b* to push the end face Wk of the workpiece W and push back the workpiece W. The control circuitry 21 then causes the contact structure 4*a* to move in the transfer direction D1 and come into contact with the end Wz of the workpiece W (step S16) and, after that, repeats step S17 and the subsequent steps.

In case that the workpiece W has the given shape (YES in step S19) and the portion to be subsequently pressed by the punch 3 is determined not to be the upstream surface end portion Ws based on the workpiece transfer program (NO in step S20), the control circuitry 21 returns to step S16 and repeats the subsequent steps.

In case that the workpiece W has the given shape (YES in step S19) and the portion to be subsequently pressed by the punch 3 is determined to be the upstream surface end portion Ws based on the workpiece transfer program (YES in step S20), the control circuitry 21 causes the contact structure 4*a* to transfer the workpiece W such that the upstream surface end portion Ws of the workpiece W is placed at a given position on the die 2 (step S21).

The control circuitry 21 causes the sucker 12 of the downstream transferer 15*b* to suck and hold the workpiece W and causes the contact structure 4*a* to withdraw from the workpiece W and, after that, causes the punch 3 to press the upstream surface end portion Ws of the workpiece W (step S22). Next, the control circuitry 21 causes the workpiece W to be transferred to a given measurement position in the direction opposite to the transfer direction D1 and then calculates parameters related to the shape of the pressed portion of the workpiece W based on results of detection by the shape sensors 11 located upstream of the die 2 (step S23).

Subsequently, the control circuitry 21 determines whether the workpiece W has a given shape (step S24). In case that the workpiece W does not have the given shape (NO in step S24), the control circuitry 21 causes the contact structure 4*a* to push the end Wz of the workpiece W and transfer the workpiece W in the transfer direction D1 (step S21) and, after that, repeats step S22 and the subsequent steps. In case that the workpiece W has the given shape (YES in step S24), the control circuitry 21 ends the process of bending.

Figure 12:
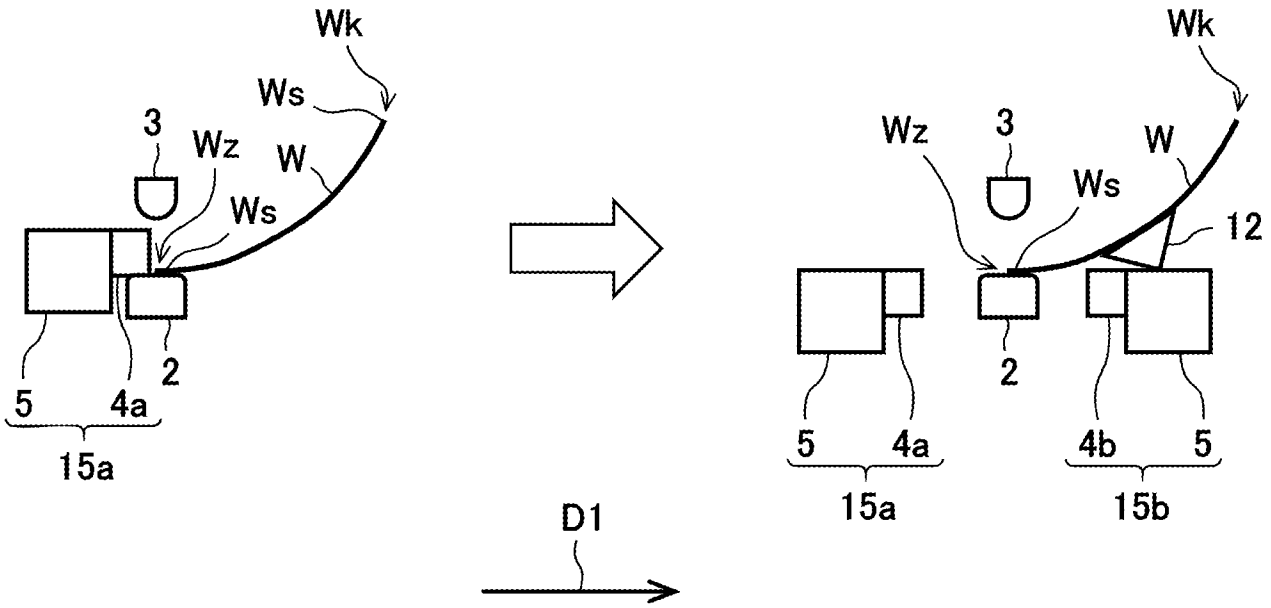
FIG. 12 is a diagram for explaining how to press a surface end portion of the workpiece by a punch.

FIG. 12 is a diagram for explaining how to press the upstream surface end portion Ws of the workpiece W by the punch 3 in steps S8 and S9 of FIG. 10 described above. When pressing the surface end portion Ws of the workpiece W by the punch 3, it is necessary to prevent interference between the punch 3 and the contact structure 4*a* pushing the end Wz.

As shown in FIG. 12, the contact structure 4*a* pushing the end Wz of the workpiece W is moved onto the die 2, and then the workpiece W is sucked and held by the sucker 12 of the downstream transferer 15*b*. The contact structure 4*a* is then moved in the direction opposite to the transfer direction D1 and withdrawn to a given position. Despite this withdrawal of the contact structure 4*a*, the workpiece W can be held in a stable position by the sucker 12.

After the contact structure 4*a* is withdrawn from the position on the die 2 in the direction opposite to the transfer direction D1, the surface end portion Ws of the workpiece W is pressed by the punch 3. Thus, the surface end portion Ws of the workpiece W can be pressed by the punch 3 without interference between the contact structure 4*a* and the punch 3. As shown in steps S1 and S2 or in steps S12 and S13, the surface end portion Ws of the workpiece W is also pressed by the punch 3 in a similar manner where the workpiece W is sucked and held by the sucker 12 of the upstream transferer 15*a*.

Figure 13:
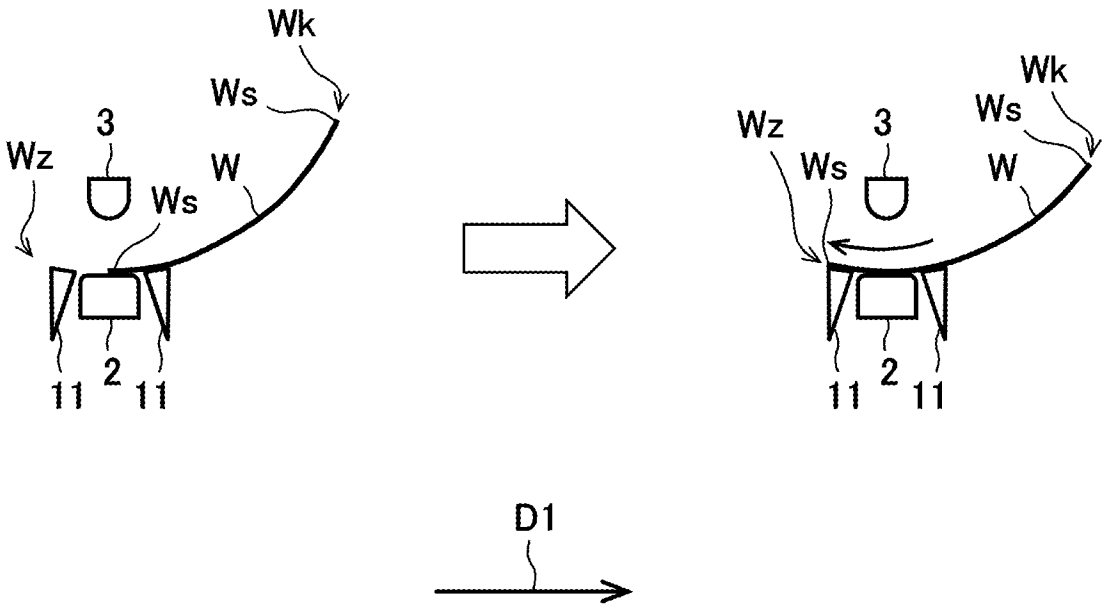
FIG. 13 is a diagram for explaining how to acquire parameters related to the shape of the surface end portion of the workpiece.

FIG. 13 is a diagram for explaining how to acquire parameters related to the shape of the surface end portion Ws of the workpiece W in step S10 of FIG. 10 described above or step S23 of FIG. 11 described above. As shown in FIG. 13, the surface end portion Ws of the workpiece W is pressed by the punch 3. The parameters related to the shape of the surface end portion Ws cannot be acquired by the downstream shape sensors 11 because the surface end portion Ws is on the die 2 and because if the workpiece W is transferred downstream, the surface end portion Ws will fall off the die 2 and become unstable. Thus, the workpiece W having undergone the pressing is pushed back in the direction opposite to the transfer direction D1 by the contact structure 4*a* or by the contact structures 4*a* and 4*b* and then sucked and held by the sucker 12 of the downstream transferer 15*b*, and the contact structure 4*a* is withdrawn in the direction opposite to the transfer direction D1. In this state, the parameters related to the shape of the surface end portion Ws are acquired by the shape sensors 11 located on the upstream side. In this case, the acquisition of the parameters by the shape sensors 11 can be performed for the workpiece W supported by the die 2. Thus, the shape of the workpiece W can be accurately determined. Although in the description of FIG. 13 the workpiece W is pushed back in the direction opposite to the transfer direction D1 by the contact structure 4*a* or by the contact structures 4*a* and 4*b*, the workpiece W may be pushed back in the direction opposite to the transfer direction D1 while being sucked by the sucker 12 of the downstream transferer 15*b*.

Figure 14:
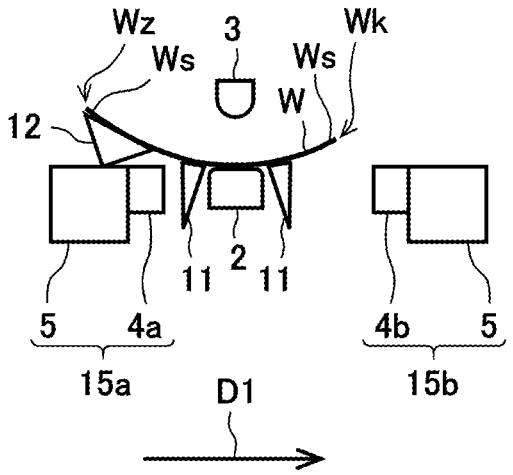
FIG. 14 is a diagram showing a situation where the parameters related to the shape of the workpiece are acquired for the workpiece held by a sucker.

FIG. 14 is a diagram showing an example which concerns step S10 of FIG. 10 described above or step S23 of FIG. 11 described above and which is different from the example of FIG. 13 or showing the details of the shape-related parameter measurement shown in step S3 of FIG. 10 or step S14 of FIG. 11. FIG. 14 depicts a situation where the parameters related to the shape of the workpiece W are acquired for the workpiece W held by the sucker 12.

As shown in FIG. 14, the parameters related to the shape of the workpiece W may be acquired by the shape sensors 11 for the workpiece W held by the sucker 12. Since the workpiece W supported by the sucker 12 and the die 2 are held in a stable position, displacement of the workpiece W can be prevented during the acquisition of the parameters. Thus, the shape of the workpiece W can be accurately determined. Although in the example of FIG. 14 the workpiece W is sucked by only the sucker 12 of the upstream transferer 15*a*, the workpiece W may be sucked by the suckers 12 of both the upstream and downstream transferers 15*a* and 15*b*.

Figure 15:
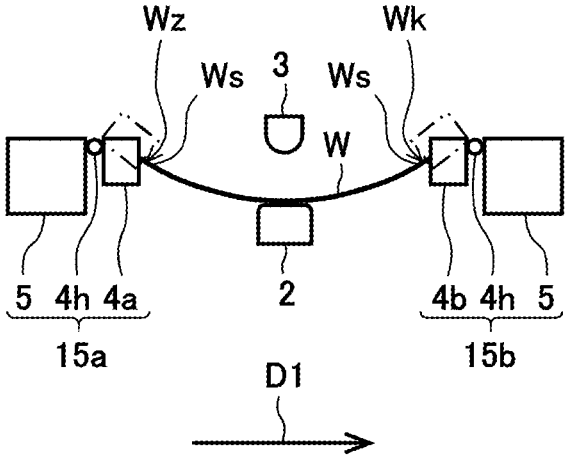
FIG. 15 is a diagram for explaining deforming structures included in the upstream and downstream transferers.

FIG. 15 is a diagram for explaining deforming structures 4*h* included in the upstream and downstream transferers 15*a* and 15*b*. FIGS. 16A to 16E are diagrams showing the flow of the process of transfer of the workpiece W by the upstream and downstream transferers 15*a* and 15*b* including the deforming structures 4*h* and the flow of the process of bending the upstream surface end portion Ws. FIGS. 16A to 16E correspond to steps S8 and S9 of FIG. 10 or steps S21 and S22 of FIG. 11. The supports 6 are omitted in FIGS. 16A to 16E.

As shown in FIG. 15, each of the upstream and downstream transferers 15*a* and 15*b* may include the deforming structure 4*h* that deforms to permit displacement of the contact structure 4*a* or 4*b* only when the contact structure 4*a* or 4*b* is subjected to a pressure equal to or higher than a predefined level or a pressure acting in a direction that is not along the transfer direction D1 of the workpiece W. The deforming structure 4*h* may be any structure that deforms when the contact structure 4*a* or 4*b* is subjected to a pressure from the workpiece W, and examples of the deforming structure 4*h* include a hinge, a spring, and an elastic material. FIG. 15 shows hinges as the deforming structures 4*h*.

The deforming structures 4*h* are located between one of the holders 5 and the contact structure 4*a* and between the other holder 5 and the contact structure 4*b*. Each of the deforming structures 4*h* deforms to permit displacement of the contact structure 4*a* or 4*b* only when the contact structure 4*a* or 4*b* is subjected to a pressure equal to or higher than a predefined level or a pressure acting in a direction that is not along the transfer direction D1 of the workpiece W. Thus, when the workpiece W is pushed and held between the contact structures 4*a* and 4*b*, the contact structure 4*a* or 4*b* is displaced only in case that the contact structure 4*a* or 4*b* is subjected to a pressure equal to or higher than a predefined level or a pressure acting in a direction that is not along the transfer direction D1 of the workpiece W. As such, overloads on the workpiece W and the contact structures 4*a* and 4*b* can be prevented without reducing the positioning accuracy of the workpiece W.

Figure 16A:
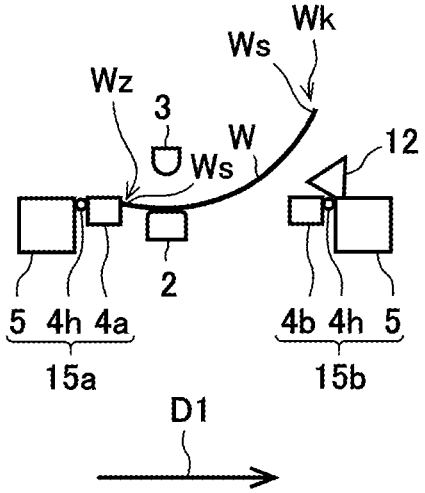
FIG. 16A is a diagram showing the flow of the process of transferring the workpiece by the upstream and downstream transferers including the deforming structures and the flow of the process of bending an end portion of the workpiece.

As shown in FIG. 16A, the upstream end face Wz of the workpiece W is pushed by the contact structure 4*a* to transfer the workpiece W to a given position, where the workpiece W is supported by the downstream support 6. In this transfer, the control circuitry 21 causes the contact structure 4*a* to be positioned such that the lower surface of the contact structure 4*a* is below the upper surface of the die 2. The downstream transferer 15*b* is kept on standby at a given position in the transfer direction D1.

Figure 16B:
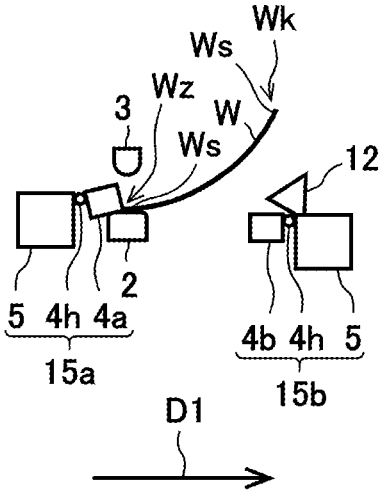
FIG. 16B is a diagram showing the flow of the process of transferring the workpiece by the upstream and downstream transferers including the deforming structures and the flow of the process of bending the end portion of the workpiece.
Figure 16C:
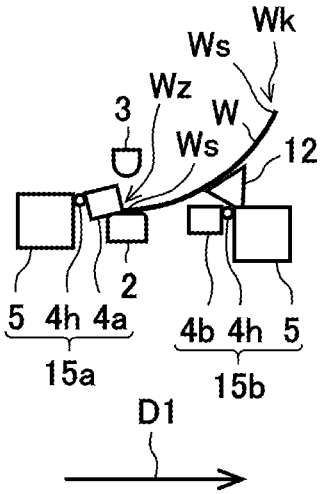
FIG. 16C is a diagram showing the flow of the process of transferring the workpiece by the upstream and downstream transferers including the deforming structures and the flow of the process of bending the end portion of the workpiece.

Next, as shown in FIG. 16B, the control circuitry 21 causes the contact structure 4*a* to move in the transfer direction D1, and upon contact of the contact structure 4*a* with the die 2, the deforming structure 4*h* embodied as a hinge opens to displace the contact structure 4*a*. As a result, the contact structure 4*a* is placed on top of the die 2. Thus, the upstream surface end portion Ws of the workpiece W, which is to be pressed by the punch 3, is supported by the die 2. After the surface end portion Ws of the workpiece W is supported by the die 2, as shown in FIG. 16C, the workpiece W is sucked and held by the sucker 12 of the downstream transferer 15*b*.

Figure 16D:
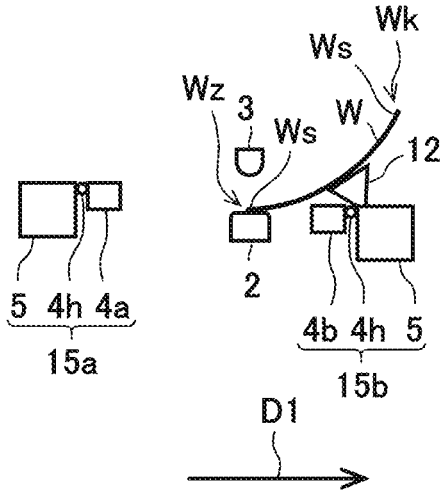
FIG. 16D is a diagram showing the flow of the process of transferring the workpiece by the upstream and downstream transferers including the deforming structures and the flow of the process of bending the end portion of the workpiece.
Figure 16E:
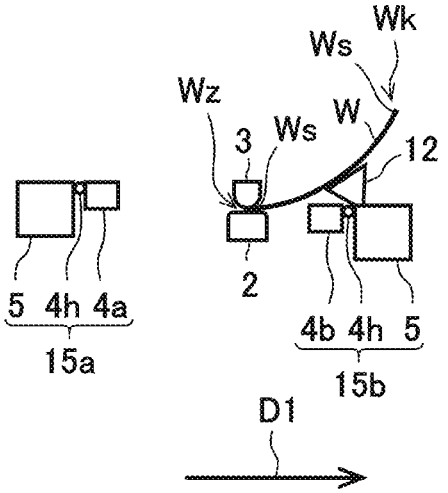
FIG. 16E is a diagram showing the flow of the process of transferring the workpiece by the upstream and downstream transferers including the deforming structures and the flow of the process of bending the end portion of the workpiece.

After the workpiece W is sucked by the sucker 12, as shown in FIG. 16D, the contact structure 4*a* is moved in the direction opposite to the transfer direction D1 and withdrawn to a given position. Despite the withdrawal of the contact structure 4*a*, the workpiece W is held in a stable position by the sucker 12. After the withdrawal of the contact structure 4*a*, as shown in FIG. 16E, the upstream surface end portion Ws of the workpiece W is pressed by the punch 3. In the case where, as in steps S12 and S13 of FIG. 11, the workpiece W is transferred in the direction opposite to the transfer direction D1 and then the downstream surface end portion Ws of the workpiece W is subjected to bending, the operations performed on the upstream side in FIGS. 16A to 16E may be performed on the downstream side, and the operations performed on the downstream side in FIGS. 16A to 16E may be performed on the upstream side.

Figure 17:
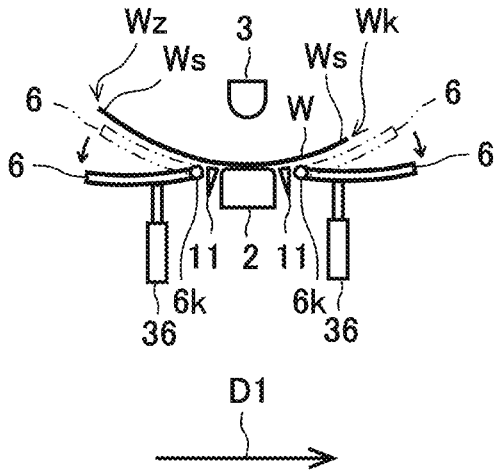
FIG. 17 is a diagram showing a situation where support drivers cause supports to pivot about given pivot shafts.
Figure 18:
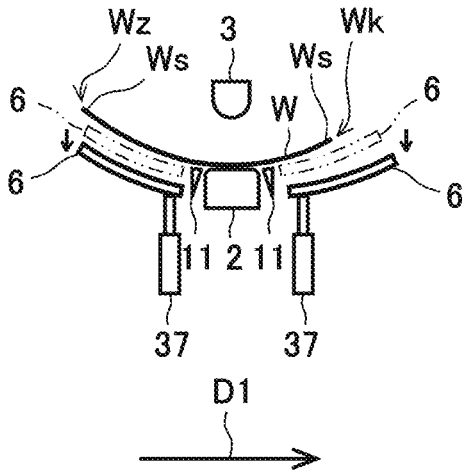
FIG. 18 is a diagram showing a situation where support drivers raise or lower the supports.

FIG. 17 is a diagram showing a situation where the support drivers 36 cause the supports 6 to pivot about given pivot shafts. FIG. 18 is a diagram showing a situation where support drivers 37 raise or lower the supports 6. The rollers 6*r* are omitted in FIG. 17 and FIG. 18.

As shown in FIG. 17, each of the supports 6 located on the upstream and downstream sides in the transfer direction D1 includes a pivot shaft 6*k* at the end of the support 6 that faces toward the die 2. The pivot shaft 6*k* is parallel to the direction in which the die 2 extends. The support drivers 36 are connected to the supports 6, respectively. Each of the support drivers 36 includes an actuator such as any type of cylinder and pushes or pulls the corresponding support 6 to cause the support 6 to pivot about the pivot shaft 6*k*. Although the support drivers 36 are provided for both the upstream and downstream supports 6, this is not limiting and the support driver 36 may be provided only for either the upstream or downstream support 6.

When parameters related to the shape of the pressed portion of the workpiece W are acquired in step S3, S6, S10, S14, S18, or S23, either of the upstream and downstream supports 6 supporting the workpiece W is caused to pivot, i.e., is moved, to stop the support 6 from supporting the workpiece W. Specifically, in the case where the pressed portion of the workpiece W, for which the shape-related parameters are to be acquired, is located on the upstream side in the transfer direction D1, the upstream support 6 is moved by the support driver 36 to stop the support 6 from supporting the workpiece W. In the case where the pressed portion of the workpiece W, for which the shape-related parameters are to be acquired, is located on the downstream side in the transfer direction D1, the downstream support 6 is moved by the support driver 36 to stop the support 6 from supporting the workpiece W. After that, the shape-related parameters are acquired by the shape sensors 11 for the pressed portion of the workpiece W which was supported by the moved support 6. Thus, the acquisition of the shape-related parameters can be accomplished without any pressure applied by the support 6 to the pressed portion subject to the acquisition, and this leads to accurate determination of the shape of the workpiece W.

When the first bending is performed on the workpiece W by the punch 3, the downstream support 6 is moved to a position where the downstream support 6 supports the workpiece W, the upstream support 6 is moved to a position where the upstream support 6 does not support the workpiece W, and then the workpiece W is pressed by the punch 3.

Instead of the configuration of FIG. 17 where the supports 6 are caused to pivot, a configuration may be employed where the supports 6 are raised or lowered by support drivers 37 as shown in FIG. 18. Each of the support drivers 37 includes an actuator such as any type of cylinder or a motor and pushes or pulls a corresponding one of the supports 6 or rotates a ball screw to raise or lower the corresponding support 6. When parameters related to the shape of the pressed portion of the workpiece W are acquired in step S3, S6, S10, S14, S18, or S23, either of the upstream and downstream supports 6 supporting the workpiece W is lowered to stop the support 6 from supporting the workpiece W.

Figure 19A:
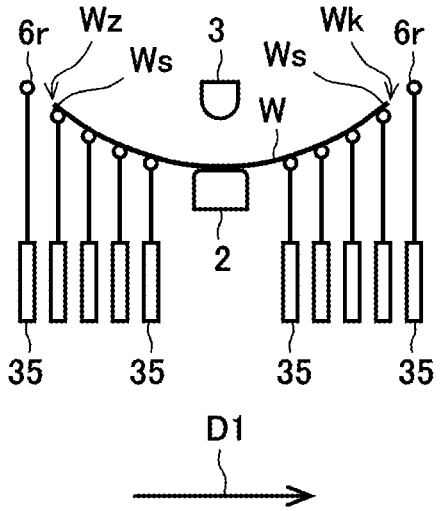
FIG. 19A is a diagram showing rollers supporting the workpiece from below.
Figure 19B:
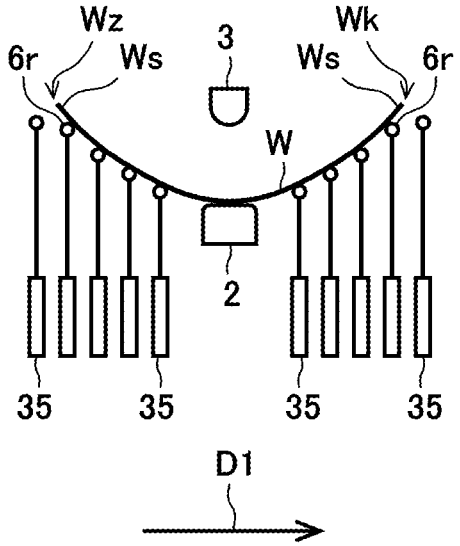
FIG. 19B is a diagram showing a situation where the rollers have been moved.

FIG. 19A is a diagram showing the rollers 6*r* supporting the workpiece W from below, and FIG. 19B is a diagram showing a situation where the rollers 6*r* have been moved. Instead of the configuration of FIG. 17 where the supports 6 are caused to pivot or the configuration of FIG. 18 where the supports 6 are raised or lowered by the support drivers 37, a configuration may be employed where the rollers 6*r* are raised or lowered by the roller drivers 35 as shown in FIGS. 19A and 19B. In this case, the rollers 6*r* function as the supports.

As shown in FIG. 19A, the roller drivers 35 are in one-to-one correspondence with the rollers 6*r*. Each of the roller drivers 35 includes an actuator such as a hydraulic cylinder, a pneumatic cylinder, an electric cylinder, a rack and pinion, or a motor and moves a corresponding one of the rollers 6*r* in a direction toward or away from the workpiece W. Each of the rollers 6*r* is independently movable to a desired position by the corresponding roller driver 35. Thus, as shown in FIG. 19B, the rollers 6*r* can be moved in accordance with the shape of the workpiece W to cause the rollers 6*r* to support the workpiece W. In the case where the arc-shaped workpiece W is supported as shown in FIG. 19B, the amount of movement of each roller 6*r* from the initial position increases as the roller 6*r* is located farther from the die 2 supporting the workpiece W in the transfer direction D1 or the direction opposite to the transfer direction D1.

Figure 20:
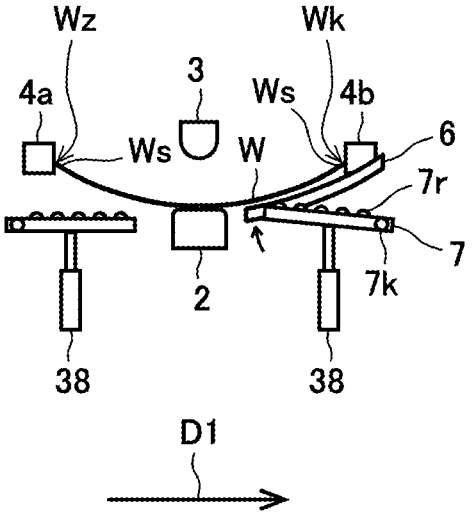
FIG. 20 is a diagram showing a situation where a downstream roller guide is caused to pivot.
Figure 21:
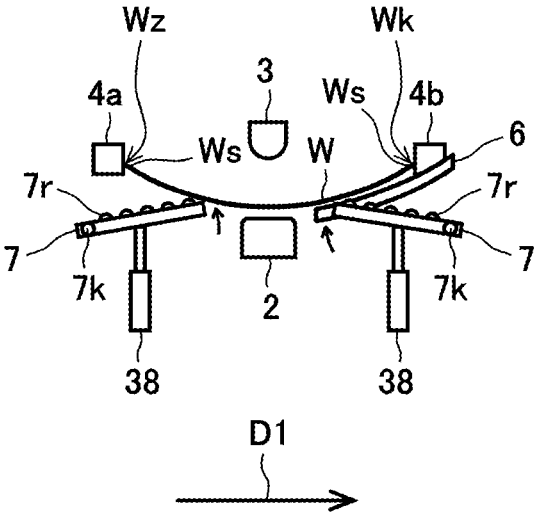
FIG. 21 is a diagram showing a situation where an upstream roller guide and the downstream roller guide are caused to pivot.

FIG. 20 is a diagram showing a situation where the downstream roller guide 7 is caused to pivot in the first bending. FIG. 21 is a diagram showing a situation where the upstream and downstream roller guides 7 are caused to pivot.

As shown in FIG. 20, each of the roller guides 7 located on the upstream and downstream sides in the transfer direction D1 includes a pivot shaft 7*k* at the end of the roller guide 7 that faces away from the die 2. The pivot shaft 7*k* is parallel to the direction in which the die 2 extends. The roller guide drivers 38 are connected to the roller guides 7, respectively. Each of the roller guide driver 38 includes an actuator such as any type of cylinder and pushes or pulls a corresponding one of the roller guides 7 to cause the corresponding roller guide 7 to pivot about the pivot shaft 7*k*. Instead of being located at the end of the roller guide 7 that faces away from the die 2 as mentioned above, the pivot shaft 7*k* may be located at any point in a direction along the transfer direction D1.

After starting transfer of the workpiece W by the contact structure 4*a* for the first bending, the downstream roller guide 7 is caused to pivot as shown in FIG. 20 to push the workpiece W from below until the workpiece W is supported by the downstream support 6. This can prevent the workpiece W from contacting the die 2 during transfer of the workpiece W. In addition, the workpiece W having its end Wz pushed by the contact structure 4*a* is prevented from moving inertially, and the workpiece W can be pressed against the contact structure 4*a* by means of the weight of the workpiece W itself. Thus, detachment of the workpiece W from the contact structure 4*a* can be prevented during transfer of the workpiece W, and the transfer accuracy can be further improved.

When the workpiece W is being transferred after the workpiece W has become supported by the downstream support 6, each of the upstream and downstream roller guides 7 is caused to pivot as shown in FIG. 21 such that the end of each roller guide 7 that faces toward the die 2 is above the opposite end of the roller guide 7. This can prevent the workpiece W from contacting the die 2 during transfer of the workpiece W.

According to the present embodiment, as described above, the workpiece W is transferred in the transfer direction D1 while pushing the contact structure 4*a* of the upstream transferer against the upstream end Wz of the workpiece W and, after being pressed by the punch 3, the workpiece W is supported from below in conformity with the shape of the workpiece W by the support 6 located on the downstream side in the transfer direction D1. Thus, in incremental forming where transfer and pressing are repeated to form the workpiece W into a desired shape, the accuracy of transfer of the workpiece W to a given position does not decrease even though the amount of bending increases with the progress of the forming process. As such, the accuracy of transfer to a position where the workpiece W is pressed by the punch 3 is higher than in a conventional configuration where the workpiece is pushed by a workpiece pusher located only on the upstream side in the transfer direction D1. Additionally, since there is no need for the step of securing supports (attachments) to the workpiece W and the step of hooking holders of movers on the supports, the workpiece W can be transferred in a simpler way than ever before.

Variants

The present disclosure is not limited to the above embodiment, and various modifications as described below may be made without departing from the gist of the present disclosure.

Although the above embodiment is configured such that the roller guide 7 pivots about the pivot shaft 7*k*, this is not limiting. For example, the roller guide 7 may be raised or lowered by means of a motor and a ball screw or may be moved in the transfer direction D1 or the opposite direction.

Although the above embodiment is configured such that the support 6 pivots about the pivot shaft 6*k*, the support 6 is raised or lowered, or the rollers 6*r* are raised or lowered, this is not limiting. For example, the support 6 may be moved by means of a motor and a ball screw in the transfer direction D1 or the opposite direction toward or away from the workpiece. In the configuration where the support 6 is moved in the transfer direction D1 or the opposite direction, parameters related to the shape of the pressed portion of the workpiece W are acquired after the support 6 is moved away from the die 2.

Although in the above embodiment the support 6 includes two or more rollers 6*r*, this is not limiting and the support 6 may include only one roller 6*r*.

Although in the above embodiment the upstream and downstream transferers 15*a* and 15*b* of the workpiece transfer device 100 have the same configuration, this is not limiting and the upstream and downstream transferers 15*a* and 15*b* may have different configurations.

In the above embodiment, proximity sensors or laser range sensors are used as the distance sensors 10 for detecting the distance between the contact structure 4*a* and the upstream end Wz of the workpiece W and the distance between the contact structure 4*b* and the downstream end Wk of the workpiece W. However, this is not limiting and different types of distance sensors 10 may be arranged in combination.

Although in the above embodiment the support drivers 36 are connected to the upstream and downstream supports 6, respectively, this is not limiting and the support driver 36 may be connected only to either the upstream or downstream support 6.

Although in the above embodiment the roller guide drivers 38 are connected to the upstream and downstream roller guides 7, respectively, this is not limiting and the roller guide driver 38 may be connected only to either the upstream or downstream roller guide 7.

Although in the above embodiment the holder 5 is moved by the guide rails 8 and 9, this is not limiting and any structure that can move the holder 5 in the first perpendicular direction D2 and the second perpendicular direction D3 may be used. For example, a conveyor may be used, or a robot such as an articulated robot may be used.

Although in the above embodiment the third driver 26*c* is a drive source such as a motor, the slide structure 31 may be slid manually along the guide rail 8.

Although in the above embodiment the first, second, and third drivers 26*a*, 26*b*, and 26*c* are motors and the slide structure 31 and raising/lowering structure 32 are ball screws, each of these drivers or structures may be any other known drive structure such as a hydraulic cylinder, a pneumatic cylinder, an electric cylinder, or a rack and pinion.

Although in FIGS. 19A and 19B described above the workpiece W is supported by the rollers 6*r* driven by the roller drivers 35, this is not limiting. A support 6 may be used which is caused to pivot by the support driver 36 and which further incorporates the rollers 6*r* driven by the roller drivers 35. Alternatively, a support 6 may be used which is raised or lowered by the support driver 37 and which further incorporates the rollers 6*r* driven by the roller drivers 35.

The configuration for implementing the control by the control circuitry 21 is not limited to that illustrated above. The functionality of the elements disclosed herein may be implemented using circuitry or processing circuitry which includes general purpose processors, special purpose processors, integrated circuits, ASICs (Application Specific Integrated Circuits), conventional circuitry and/or combinations thereof which are configured or programmed to perform the disclosed functionality. Processors are considered processing circuitry or circuitry as they include transistors and other circuitry therein. In the disclosure, the circuitry, units, or means are hardware that carry out or are programmed to perform the recited functionality. The hardware may be any hardware disclosed herein or otherwise known which is programmed or configured to carry out the recited functionality. When the hardware is a processor which may be considered a type of circuitry, the circuitry, means, or units are a combination of hardware and software, the software being used to configure the hardware and/or processor.

According to the present disclosure, the workpiece is transferred in the transfer direction while pushing the upstream transferer against the upstream end of the workpiece and, after being pressed by the punch, the workpiece is supported from below in conformity with the shape of the workpiece by the support located on the downstream side in the transfer direction. Thus, in incremental forming where transfer and pressing are repeated to form the workpiece into a desired shape, the accuracy of transfer of the workpiece to a given position does not decrease even though the amount of bending increases with the progress of the forming process. As such, the accuracy of transfer to a position where the workpiece is pressed by the punch is higher than in a conventional configuration where the workpiece is pushed by a workpiece pusher located only on the upstream side in the transfer direction. Additionally, since there is no need for the step of securing supports (attachments) to the workpiece and the step of hooking holders of movers on the supports, the workpiece can be transferred in a simpler way than ever before.

In the above disclosure, a downstream transferer located on the downstream side in the transfer direction of the workpiece may be moved in the transfer direction; the upstream transferer may be moved in the transfer direction while pushing the upstream transferer against the upstream end of the workpiece; and the downstream transferer may be moved into contact with the downstream end of the workpiece, and the workpiece may be intermittently transferred in the transfer direction.

According to the above configuration, a decrease in transfer accuracy can be avoided even during re-bending of the workpiece.

In the above disclosure, a target position to which the upstream transferer is moved may be stored into a storage; the target position of the upstream transferer may be acquired from the storage; and the upstream transferer may be moved based on the target position of the upstream transferer, and the workpiece may be transferred in the transfer direction.

According to the above configuration, the workpiece can be reliably transferred by a predefined amount.

In the above disclosure, distance-related information related to a distance between the upstream transferer and the end of the workpiece may be detected; and operation of the press brake and operation of the upstream transferer may be changed in accordance with the distance-related information.

According to the above configuration, forming failure can be avoided which is due to the presence of a gap between the upstream transferer and the workpiece being transferred.

In the above disclosure, one of the upstream transferer and a downstream transferer located on the downstream side with respect to the press brake in the transfer direction may include a sucker that sucks the workpiece; the workpiece may be sucked and held by the sucker of the one of the upstream and downstream transferers; and the other of the upstream and downstream transferers may be moved away from the press brake to stop the other of the upstream and downstream transferers from pushing an end of the workpiece.

According to the above configuration, interference between the punch and the transferer that pushes the end of the workpiece can be prevented.

In the above disclosure, each of the upstream transferer and a downstream transferer located on the downstream side with respect to the press brake in the transfer direction may include a contact structure that contacts an end face of the workpiece and a deforming structure that deforms to permit displacement of the contact structure when the contact structure is subjected to a pressure equal to or higher than a predefined level or a pressure acting in a direction that is not along the transfer direction of the workpiece. Before a surface end portion of the workpiece that is on the upstream side or the downstream side in the transfer direction is pressed by the punch, the workpiece may be transferred by bringing the contact structure of one of the upstream and downstream transferers into contact with the workpiece and moving the one of the upstream and downstream transferers toward the press brake while keeping a lower surface of the contact structure below an upper surface of the die; the contact structure may be displaced onto the die by deformation of the deforming structure upon contact of the contact structure with the die; the workpiece may be sucked and held by a sucker included in the other of the upstream and downstream transferers; and the one of the upstream and downstream transferers may be withdrawn away from the press brake.

According to the above configuration, displacing the contact structure by deformation of the deforming structure upon contact of the contact structure with the die allows the end of the workpiece to be transferred to a position on the die. Additionally, sucking and holding the workpiece by the sucker enables withdrawal of one of the transferers, thus making it possible to prevent interference between the one of the transferers and the punch.

In the above disclosure, after a surface end portion of the workpiece that is on one of the upstream and downstream sides in the transfer direction is pressed by the punch, the workpiece may be moved toward the one of the upstream and downstream sides in the transfer direction by a transferer located on the one of the upstream and downstream sides or by transferers located on both the upstream and downstream sides, and a shape of the surface end portion of the workpiece that was pressed by the punch may be measured.

According to the above configuration, the measurement can be performed for the workpiece supported stably by the die.

In the above disclosure, after a surface end portion of the workpiece that is on one of the upstream and downstream sides in the transfer direction is pressed by the punch, the workpiece may be sucked by a sucker included in a transferer located on the other of the upstream and downstream sides and moved toward the one of the upstream and downstream sides in the transfer direction; and the workpiece may be sucked and held by the sucker included in the transferer located on the other of the upstream and downstream sides, and a shape of the surface end portion of the workpiece that was pressed by the punch may be measured.

According to the above configuration, forming failure of the workpiece can be detected.

In the above disclosure, the support, which is located on the downstream side in the transfer direction, may be moved toward or away from the workpiece in accordance with the shape of the workpiece, and another support may be moved toward or away from the workpiece in accordance with the shape of the workpiece, the other support being a support that is located on the upstream side in the transfer direction and that supports the workpiece from below in conformity with the shape of the workpiece after pressing of the workpiece by the punch.

According to the above disclosure, the workpiece can be supported in accordance with the varying shape of the workpiece.

In the above disclosure, one of the supports on the upstream and downstream sides may be moved to stop the one of the supports from supporting the workpiece, and a shape of a portion of the workpiece that was supported by the moved support and that was pressed by the punch may be measured.

According to the above configuration, the portion of the workpiece, whose shape is to be measured, can avoid being subjected to a moment applied by the support. This can prevent the workpiece from being pressed and bent by the support, thus ensuring accurate measurement of parameters related to the shape of the workpiece.

In the above disclosure, the support on the downstream side may be moved to a position where the support supports the workpiece, the other support on the upstream side may be moved to a position where the other support does not support the workpiece, and the workpiece may be transferred.

According to the above configuration, the withdrawal of the upstream support can prevent the upstream support from interfering with the flat sheet-shaped portion (portion yet to be pressed by the punch) of the workpiece that is on the upstream side in the transfer direction.

In the above disclosure, a roller guide may be moved or caused to pivot to push the workpiece from below with the roller guide, the roller guide being a roller guide that is located on the downstream side with respect to the press brake in the transfer direction, that supports the workpiece from below, and that moves upward and downward, pivots about an axis parallel to a direction in which the die extends, or moves in the transfer direction and a direction opposite to the transfer direction; and the end of the workpiece may be brought into contact with the upstream transferer, and the workpiece may be transferred.

According to the above configuration, after the start of transfer of the workpiece by the upstream and downstream transferers, the downstream roller guide can be moved to push the workpiece from below until the workpiece is supported by the downstream support. This can prevent the workpiece from contacting the die during transfer of the workpiece. In addition, the workpiece can be pressed against the upstream transferer and prevented from being released from pushing by the upstream transferer.

In the above disclosure, roller guides may be moved or caused to pivot to position one end of each of the roller guides above an opposite end of each of the roller guides, and the workpiece may be transferred, the roller guides being roller guides that are located on the upstream and downstream sides with respect to the press brake in the transfer direction, that support the workpiece from below, and each of which moves upward and downward, pivots about an axis parallel to a direction in which the die extends, or moves in the transfer direction and a direction opposite to the transfer direction, the one end of each of the roller guides being an end facing toward the press brake.

According to the above configuration, after the workpiece is supported by the downstream support, each of the upstream and downstream roller guides is caused to pivot to position the press brake-facing end of each roller guide above the opposite end of the roller guide. This can prevent the workpiece from contacting the die during transfer of the workpiece.

In the above disclosure, the workpiece transfer device may further include a storage storing a target position to which the upstream transferer is moved, and the control circuitry may be configured to: acquire the target position of the upstream transferer from the storage; and control the transfer driver to move the upstream transferer based on the target position of the upstream transferer.

In the above disclosure, the workpiece transfer device may further include a distance sensor that detects distance-related information related to a distance between the upstream transferer and the end of the workpiece, and the control circuitry may be configured to change operation of the press brake and operation of the upstream transferer in accordance with the distance-related information detected by the distance sensor.

In the above disclosure, the workpiece transfer device may further include a downstream transferer that is located on the downstream side with respect to the press brake in the transfer direction of the workpiece, each of the upstream and downstream transferers may include: a contact structure that contacts an end face of the workpiece; a deforming structure that deforms to permit displacement of the contact structure when the contact structure is subjected to a pressure equal to or higher than a predefined level or a pressure acting in a direction that is not along the transfer direction of the workpiece; and a connector that holds the deforming structure and that is connected to the transfer driver.

In the above disclosure, the contact structure of the upstream transferer may include a positioning lock shaped to conform to a lock receiver located at the upstream end of the workpiece in the transfer direction.

According to the above configuration, the engagement of the positioning lock with the lock receiver allows for accurate positioning of the workpiece in a transverse direction crossing the transfer direction.

In the above disclosure, the workpiece transfer device may further include: a downstream transferer that is located on the downstream side with respect to the press brake in the transfer direction of the workpiece; and a sucker that is included in the upstream transferer or the downstream transferer and that sucks and holds the workpiece.

In the above disclosure, the workpiece transfer device may further include arc-shaped supports that are located on the upstream and downstream sides with respect to the press brake in the transfer direction and that support the workpiece from below.

In the above disclosure, each of the supports may include rollers that move toward and away from the workpiece, and the workpiece transfer device may further include roller drivers that are in one-to-one correspondence with the rollers and each of which moves a corresponding one of the rollers.

In the above disclosure, the workpiece transfer device may further include support drivers each of which causes a corresponding one of the supports to pivot about a given pivot shaft.

In the above disclosure, the workpiece transfer device may further include transverse-direction support drivers each of which moves a corresponding one of the supports in the transfer direction or a transverse direction crossing the transfer direction.

In the above disclosure, the workpiece transfer device may further include roller guides that are located on the upstream and downstream sides with respect to the press brake in the transfer direction, that support the workpiece, and each of which pivots about a given pivot shaft, moves in the transverse direction, or moves in the transfer direction.

What is claimed is:

1. A workpiece transfer method for transferring a workpiece when bending of the workpiece is performed by a press brake including a die that supports the workpiece and a punch that is located above the die and presses the workpiece supported by the die, the workpiece transfer method comprising, before or after the bending:

moving an upstream transferrer in a transfer direction of the workpiece while pushing the upstream transferrer against an end of the workpiece, the upstream transferrer being located on an upstream side with respect to the press brake in the transfer direction, the end of the workpiece being an upstream end in the transfer direction; and supporting the workpiece from below by a support in conformity with a shape of the workpiece after pressing of the workpiece by the punch, and intermittently transferring the workpiece in the transfer direction, the support being located on a downstream side with respect to the press brake in the transfer direction, wherein each of the upstream transferrer and a downstream transferrer located on the downstream side with respect to the press brake in the transfer direction includes:

a contact structure that contacts an end face of the workpiece;

a deforming structure that deforms to permit displacement of the contact structure when the contact structure is subjected to a pressure equal to or higher than a predefined level or a pressure acting in a direction that is not along the transfer direction of the workpiece; and a connector that holds the deforming structure and that is connected to a transfer driver that moves the upstream transferrer in the transfer direction.

2. The workpiece transfer method according to claim 1, further comprising:

moving the downstream transferrer in the transfer direction of the workpiece, the downstream transferrer being located on the downstream side in the transfer direction;

moving the upstream transferrer in the transfer direction of the workpiece while pushing the upstream transferrer against the upstream end of the workpiece; and moving the downstream transferrer into contact with a downstream end of the workpiece and intermittently transferring the workpiece in the transfer direction.

3. The workpiece transfer method according to claim 1, further comprising:

storing a target position into a storage, the target position being a position to which the upstream transferrer is moved;

acquiring the target position of the upstream transferrer from the storage; and moving the upstream transferrer based on the target position of the upstream transferrer and transferring the workpiece in the transfer direction.

4. The workpiece transfer method according to claim 1, further comprising:

detecting distance-related information related to a distance between the upstream transferrer and the end of the workpiece; and changing operation of the press brake and operation of the upstream transferrer in accordance with the distance-related information.

5. The workpiece transfer method according to claim 1, wherein one of the upstream transferrer and a downstream transferrer located on the downstream side with respect to the press brake in the transfer direction includes a sucker that sucks the workpiece, and the workpiece transfer method further comprises:

sucking and holding the workpiece by the sucker of the one of the upstream and downstream transferrers; and moving the other of the upstream and downstream transferrers away from the press brake to stop the other of the upstream and downstream transferrers from pushing an end of the workpiece.

6. The workpiece transfer method according to claim 1, wherein each of the upstream transferrer and a downstream transferrer located on the downstream side with respect to the press brake in the transfer direction includes a contact structure that contacts an end face of the workpiece and a deforming structure that deforms to permit displacement of the contact structure when the contact structure is subjected to a pressure equal to or higher than a predefined level or a pressure acting in a direction that is not along the transfer direction of the workpiece, and the workpiece transfer method further comprises, before a surface end portion of the workpiece that is on the upstream side or the downstream side in the transfer direction is pressed by the punch:

transferring the workpiece by bringing the contact structure of one of the upstream and downstream transferrers into contact with the workpiece and moving the one of the upstream and downstream transferrers toward the press brake while keeping a lower surface of the contact structure below an upper surface of the die;

displacing the contact structure onto the die by deformation of the deforming structure upon contact of the contact structure with the die;

sucking and holding the workpiece by a sucker included in the other of the upstream and downstream transferrers; and withdrawing the one of the upstream and downstream transferrers away from the press brake.

7. The workpiece transfer method according to claim 1, further comprising, after a surface end portion of the workpiece that is on one of the upstream and downstream sides in the transfer direction is pressed by the punch:

moving the workpiece toward the one of the upstream and downstream sides in the transfer direction by a transferrer located on the one of the upstream and downstream sides or by transferrers located on both the upstream and downstream sides, and measuring a shape of the surface end portion of the workpiece that was pressed by the punch.

8. The workpiece transfer method according to claim 1, further comprising, after a surface end portion of the workpiece that is on one of the upstream and downstream sides in the transfer direction is pressed by the punch:

sucking the workpiece by a sucker included in a transferrer located on the other of the upstream and downstream sides and moving the workpiece toward the one of the upstream and downstream sides in the transfer direction; and sucking and holding the workpiece by the sucker included in the transferrer located on the other of the upstream and downstream sides, and measuring a shape of the surface end portion of the workpiece that was pressed by the punch.

9. The workpiece transfer method according to claim 1, further comprising:

moving the support, which is located on the downstream side in the transfer direction, toward or away from the workpiece in accordance with the shape of the workpiece; and moving another support toward or away from the workpiece in accordance with the shape of the workpiece, the other support being a support that is located on the upstream side in the transfer direction and that supports the workpiece from below in conformity with the shape of the workpiece after pressing of the workpiece by the punch.

10. The workpiece transfer method according to claim 9, further comprising:

moving one of the supports on the upstream and downstream sides to stop the one of the supports from supporting the workpiece; and measuring a shape of a portion of the workpiece that was supported by the moved support and that was pressed by the punch.

11. The workpiece transfer method according to claim 9, further comprising:

moving the support on the downstream side to a position where the support supports the workpiece and the other support on the upstream side to a position where the other support does not support the workpiece, and transferring the workpiece.

12. The workpiece transfer method according to claim 9, further comprising:

moving a roller guide, or causing the roller guide to pivot, to push the workpiece from below with the roller guide, the roller guide being a roller guide that is located on the downstream side with respect to the press brake in the transfer direction, that supports the workpiece from below, and that moves upward and downward, pivots about an axis parallel to a direction in which the die extends, or moves in the transfer direction and a direction opposite to the transfer direction; and bringing the end of the workpiece into contact with the upstream transferrer and transferring the workpiece.

13. The workpiece transfer method according to claim 9, further comprising:

moving roller guides, or causing the roller guides to pivot, to position one end of each of the roller guides above an opposite end of each of the roller guides, the roller guides being roller guides that are located on the upstream and downstream sides with respect to the press brake in the transfer direction, that support the workpiece from below, and each of which moves upward and downward, pivots about an axis parallel to a direction in which the die extends, or moves in the transfer direction and a direction opposite to the transfer direction, the one end of each of the roller guides being an end facing toward the press brake; and transferring the workpiece.

14. A workpiece transfer device that transfers a workpiece when bending of the workpiece is performed by a press brake including a die that supports the workpiece and a punch that is located above the die and presses the workpiece, the workpiece transfer device comprising:

an upstream transferrer that is located on an upstream side with respect to the press brake in a transfer direction of the workpiece;

a transfer driver that moves the upstream transferrer in the transfer direction;

a support that is located on a downstream side with respect to the press brake in the transfer direction and that supports the workpiece from below in conformity with a shape of the workpiece after pressing of the workpiece by the punch;

control circuitry configure to, before or after the bending, control the transfer driver to intermittently transfer the workpiece in the transfer direction by moving the upstream transferrer in the transfer direction while pushing the upstream transferrer against an upstream end of the workpiece; and a downstream transferrer that is located on the downstream side with respect to the press brake in the transfer direction of the workpiece, wherein each of the upstream and downstream transferrers includes:

a contact structure that contacts an end face of the workpiece;

a deforming structure that deforms to permit displacement of the contact structure when the contact structure is subjected to a pressure equal to or higher than a predefined level or a pressure acting in a direction that is not along the transfer direction of the workpiece; and a connector that holds the deforming structure and that is connected to the transfer driver.

15. The workpiece transfer device according to claim 14, further comprising a storage storing a target position to which the upstream transferrer is moved, wherein the control circuitry is configured to:

acquire the target position of the upstream transferrer from the storage; and control the transfer driver to move the upstream transferrer based on the target position of the upstream transferrer.

16. The workpiece transfer device according to claim 14, further comprising a distance sensor that detects distance-related information related to a distance between the upstream transferrer and the end of the workpiece, wherein the control circuitry is configured to change operation of the press brake and operation of the upstream transferrer in accordance with the distance-related information detected by the distance sensor.

17. The workpiece transfer device according to claim 14, wherein the contact structure of the upstream transferrer includes a positioning lock shaped to conform to a lock receiver located at the upstream end of the workpiece in the transfer direction.

18. The workpiece transfer device according to claim 14, further comprising:

a sucker that is included in the upstream transferrer or the downstream transferrer and that sucks and holds the workpiece.

19. The workpiece transfer device according to claim 14, further comprising arc-shaped upstream supports that are located on the upstream sides with respect to the press brake in the transfer direction and that support the workpiece from below.

20. The workpiece transfer device according to claim 19, wherein each of the supports includes rollers that move toward and away from the workpiece, and the workpiece transfer device further comprises roller drivers that are in one-to-one correspondence with the rollers and each of which moves a corresponding one of the rollers.

21. The workpiece transfer device according to claim 19, further comprising support drivers each of which causes a corresponding one of the supports to pivot about a given pivot shaft.

22. The workpiece transfer device according to claim 19, further comprising transverse-direction support drivers each of which moves a corresponding one of the supports in the transfer direction or a transverse direction crossing the transfer direction.

23. The workpiece transfer device according to claim 14, further comprising roller guides that are located on the upstream and downstream sides with respect to the press brake in the transfer direction, that support the workpiece, and each of which pivots about a given pivot shaft, moves in the transverse direction, or moves in the transfer direction.

24. A non-transitory computer readable medium storing computer executable instructions which, when executed by a computer in a workpiece transfer device that transfers a workpiece when bending of the workpiece is performed by a press brake including a die that supports the workpiece and a punch that is located above the die and presses the workpiece supported by the die, cause the computer to execute a process to, before or after the bending:

move an upstream transferrer in a transfer direction of the workpiece while pushing the upstream transferrer against an end of the workpiece, the upstream transferrer being located on an upstream side with respect to the press brake in the transfer direction, the end of the workpiece being an upstream end in the transfer direction; and cause a support to support the workpiece from below in conformity with a shape of the workpiece after pressing of the workpiece by the punch, and intermittently transfer the workpiece in the transfer direction, the support being located on a downstream side with respect to the press brake in the transfer direction, wherein each of the upstream transferrer and a downstream transferrer located on the downstream side with respect to the press brake in the transfer direction includes:

a contact structure that contacts an end face of the workpiece;

a deforming structure that deforms to permit displacement of the contact structure when the contact structure is subjected to a pressure equal to or higher than a predefined level or a pressure acting in a direction that is not along the transfer direction of the workpiece; and a connector that holds the deforming structure and that is connected to a transfer driver that moves the upstream transferrer in the transfer direction.

* * * * *